US011926466B1

(12) United States Patent
Vida et al.

(10) Patent No.: US 11,926,466 B1
(45) Date of Patent: Mar. 12, 2024

(54) SELF-LIFTING SUPPLY CONTAINER

(71) Applicants: Justin Vida, Lake Lure, NC (US); Pamela Vida, Monaca, PA (US)

(72) Inventors: Justin Vida, Lake Lure, NC (US); Pamela Vida, Monaca, PA (US)

( * ) Notice: Subject to any disclaimer, the term of this patent is extended or adjusted under 35 U.S.C. 154(b) by 0 days.

(21) Appl. No.: 18/512,097

(22) Filed: Nov. 17, 2023

(51) Int. Cl.
*B65D 83/00* (2006.01)

(52) U.S. Cl.
CPC ..... *B65D 83/005* (2013.01)

(58) Field of Classification Search
CPC ..... B65D 83/005; B65D 83/0083; B65D 83/0088; B65D 83/0427
USPC ..... 206/761, 806, 804, 814, 756, 736, 765; 221/208, 209, 284, 283, 296
See application file for complete search history.

(56) References Cited

U.S. PATENT DOCUMENTS 3,231,139 A * 1/1966 Bouet ..... B65D 83/0481 222/326
6,634,921 B1 * 10/2003 Coulthard, Jr. ..... A63H 5/00 446/221
7,407,064 B2 * 8/2008 Chirnomas ..... G07F 11/10 221/210
7,407,086 B2 * 8/2008 Borio ..... B65D 19/20 229/101
7,987,988 B2 * 8/2011 Johnson ..... A45C 11/16 206/769
2007/0056968 A1 * 3/2007 Giwargis ..... B65D 83/005 220/8
2013/0037445 A1 * 2/2013 Williams ..... A47F 3/06 206/761
2015/0108122 A1 * 4/2015 Jimdar ..... B65D 83/005 220/8

FOREIGN PATENT DOCUMENTS

CA 2745156 A1 * 12/2011 ..... B65D 83/005
GB 2500015 A * 9/2013 ..... B65D 81/22

* cited by examiner

*Primary Examiner* — Rafael A Ortiz
(74) *Attorney, Agent, or Firm* — H. Brock Kolls

(57) ABSTRACT

The present invention relates to a self-lifting supply container that includes a movable tray, guides fastened to the movable tray, and container walls with tracks cut therethrough. The movable tray fits within the container walls allowing the movable tray to slide up and down the tracks. Elastic bands pass over pulleys that are secured to the container bottom and the guides. In operation, the weight of a supply material added to the movable tray causes the movable tray to descend into the container tower, tensioning the elastic bands and removing a portion of the supply material, reducing weight on the movable tray causes the movable tray to partially ascend the container tower keeping the supply material accessible to a user proximate to the container top regardless of the amount of the supply material remaining on the movable tray within the self-lifting supply container.

20 Claims, 21 Drawing Sheets

402
102
100
118/142
202
106
104
144
154/164
302
204
108
154/164
108
154/164
112
156/160
156/160
112
136/162
112
156/160

A
B
108
108
172
168
168
170
164
164
164
164
164
164
164
134
162
162
166
166
136
136
138
140
140
140
140
160

SELF-LIFTING SUPPLY CONTAINER

TECHNICAL FIELD OF THE INVENTION

This invention relates to a self-lifting supply container and particularly to a container for storing a supply of food or other supply materials. When the weight of the supply material is added to the movable tray it causes the movable tray to descend into the container tower, tensioning elastic bands, and when removing a portion of the supply material, reducing weight on the movable tray, it causes the movable tray to partially ascend the container tower keeping the supply material accessible to a user proximate to the container top regardless of the amount of the supply material remaining on the movable tray within the self-lifting supply container.

BACKGROUND OF THE INVENTION

Before our invention dog owners and others often used large containers to store their pet's dry food. A shortcoming of these large containers is that they can require lots of floor or shelf space. While a narrower container would aid in reducing the amount of floor or shelf space required, it would necessarily have to be much taller to accommodate the same amount of dog food as the large container.

A shortcoming of narrower but taller containers is that as the food supply is depleted the pet caregiver must reach deeper and deeper into the tall container which can be difficult, particularly when trying to scoop food out of the container.

The present invention addresses these and other shortcomings by providing a self-lifting supply container and other advantages. For these reasons and shortcomings as well as other reasons and shortcomings there is a long-felt need that gives rise to the present invention.

SUMMARY OF THE INVENTION

The shortcomings of the prior art are overcome and additional advantages are provided through the provision of a self-lifting supply container that comprises a movable tray, and at least one guide that is fastened to each side of the outer perimeter of the movable tray. The guide comprises a body portion that is narrow and a head portion that is connected to and wider than the body portion.

The self-lifting supply container further comprises more than one container wall. Each of the container walls has at least one track cut therethrough. Each of the container walls is secured proximate to each other forming a container tower. The container tower has a container top, a container bottom, an interior container region, and an exterior container surface. The track is orientated vertically running substantially from the container top to proximate the container bottom. The movable tray is sized to fit within the interior container region with the body portion of the guide fitting through the track and the head portion of the guide positioned proximate to the exterior container surface retaining the movable tray within the interior container region and allowing the movable tray to slide up and down the track within the interior container region.

The self-lifting supply container further comprises more than one pulley which is secured on the exterior container surface of each of the container walls proximate to the container top, and more than one elastic band. One end of each of the elastic bands is attached to the exterior container surface of the container wall proximate to the container bottom, and the other end of the elastic band passes over the pulley and is secured to the guide.

In operation, the weight of a supply material added to the movable tray causes the movable tray to descend into the container tower, tensioning by stretching the elastic bands, and removing a portion of the supply material, reducing weight on the movable tray causes the movable tray to partially ascend the container tower, by way of tension in the elastic band, lifting the movable tray and the supply material on the movable tray. In this regard, the supply material is accessible to a user proximate to the container top regardless of the amount of the supply material remaining on the movable tray within the interior container region of the self-lifting supply container.

Additional shortcomings of the prior art are overcome and additional advantages are provided through the provision of a method using a self-lifting supply container. The method comprises the step of filling, by way of a user, the self-lifting supply container with a supply material. In operation, the weight of the supply material added to a movable tray causes the movable tray to descend into a container tower, tensioning by stretching one or more elastic bands.

The self-lifting supply container comprises the movable tray, and at least one guide is fastened to each side of the outer perimeter of the movable tray, the guide comprises a body portion that is narrow and a head portion that is connected to and wider than the body portion.

The self-lifting supply container further comprises more than one container wall. Each of the container walls has at least one track cut therethrough. Each of the container walls is secured proximate to each other forming the container tower. The container tower has a container top, a container bottom, an interior container region, and an exterior container surface. The track is orientated vertically running substantially from the container top to proximate the container bottom. The movable tray is sized to fit within the interior container region with the body portion of the guide fitting through the track and the head portion of the guide positioned proximate to the exterior container surface retaining the movable tray within the interior container region and allowing the movable tray to slide up and down the track within the interior container region.

The self-lifting supply container further comprises more than one pulley that is secured on the exterior container surface of each of the container walls proximate to the container top, and more than one of the elastic bands. One end of each of the elastic bands is attached to the exterior container surface of the container wall proximate to the container bottom, and the other end of the elastic band passes over the pulley and is secured to the guide.

The method then continues by removing, by way of the user, a portion of the supply material, reducing the weight on the movable tray causing the movable tray to partially ascend the container tower by way of tension in the elastic band lifting the movable tray and the supply material on the movable tray. In operation, the supply material is accessible to the user proximate to the container top regardless of the amount of the supply material remaining on the movable tray within the interior container region of the self-lifting supply container.

Additional shortcomings of the prior art are overcome and additional advantages are provided through the provision of a self-lifting supply container which comprises a movable tray, and at least one guide that is fastened to each side of the outer perimeter of the movable tray. The guide comprises a body portion that is narrow and a head portion that is connected to and wider than the body portion.

The self-lifting supply container further comprises more than one container wall. Each of the container walls has at least one track cut therethrough. Each of the container walls is secured proximate to each other forming a container tower. The container tower has a container top, a container bottom, an interior container region, and an exterior container surface. The track is orientated vertically running substantially from the container top to proximate the container bottom. The movable tray is sized to fit within the interior container region with the body portion of the guide fitting through the track and the head portion of the guide positioned proximate to the exterior container surface retaining the movable tray within the interior container region and allowing the movable tray to slide up and down the track within the interior container region.

The self-lifting supply container further comprises pulleys secured on the exterior container surface of each of the container walls proximate to the container top and more than one elastic band. One end of each of the elastic band is attached to the exterior container surface of the container wall proximate to the container bottom, and the other end of the elastic band passes over the pulley and is secured to the guide.

The self-lifting supply container further comprises a lid. The lid comprises a first interlocking row of ridges integrally formed along one perimeter edge and a collar that is sized to fit the perimeter of the container tower and fastens to the container top. The collar has a top collar surface and a bottom collar surface. Lid is sized to cover the collar. The collar comprises a second interlocking row of ridges integrally formed along one perimeter edge. The first interlocking row of ridges and the second interlocking row of ridges are movably interconnected such that the lid can be opened by the user to access a supply material within the container interior region, and closed to cover the supply material within the container interior region.

The self-lifting supply container further comprises more than one panel. The panel comprises a top panel edge, a bottom panel edge, a left panel edge, a right panel edge, an exterior panel surface, and an interior panel surface. At least one of the panels is attached to the exterior container surface of each of the container walls. A panel contoured lip is formed on the bottom panel edge on at least two of the panels that are opposed, and a bottom plate comprises a contoured lip on at least two opposing perimeter edges. The contoured lip engages the top surface of the panel contoured lip securing the bottom plate proximate to the bottom of the container tower. The bottom plate covers the container bottom.

The self-lifting supply container further comprises more than one footer formed into a U-shape. The U-shape creates a panel gap. The footer has a footer mounting hole therethrough. Adjacent left panel edge and the right panel edge overlap and slide into the panel gap and a footer fastener passes through the footer mounting hole securing the footer to the panel.

In operation, the weight of the supply material added to the movable tray causes the movable tray to descend into the container tower, tensioning by stretching the elastic bands, and removing a portion of the supply material, reducing weight on the movable tray causes the movable tray to partially ascend the container tower, by way of tension in the elastic band, lifting the movable tray and the supply material on the movable tray. In this regard, the supply material is accessible to the user proximate to the container top regardless of the amount of the supply material remaining on the movable tray within the interior container region of the self-lifting supply container.

Additional features and advantages are realized through the techniques of the present invention. Other embodiments and aspects of the invention are described in detail herein and are considered a part of the claimed invention. For a better understanding of the invention with advantages and features, refer to the description and the drawings.

BRIEF DESCRIPTION OF THE FIGURES

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF THE INVENTION

Figure 1:
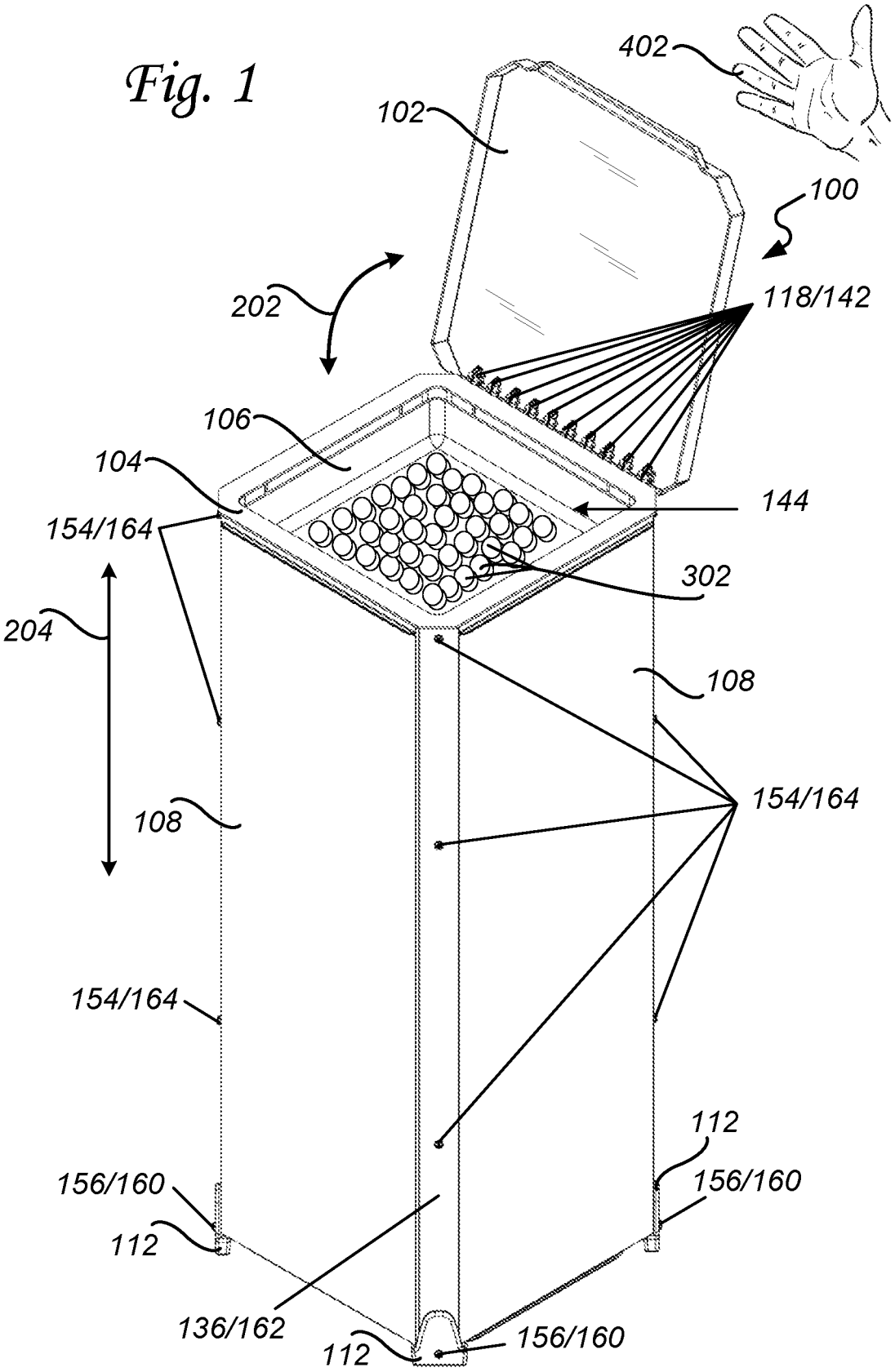
FIG. 1 illustrates one example of a self-lifting supply container with an open lid.

Turning now to the drawings in greater detail, it will be seen that in FIG. 1 there is illustrates one example of a self-lifting supply container 100 with an open lid 102. In an exemplary embodiment, a lid 102 can be opened 202 and supply material 302 such as a dog food supply or other types of kinds of supply material can be placed on a movable tray 106 within the self-lifting supply container 100.

For disclosure purposes, the self-lifting supply container 100 of the present invention can be a food supply material container or used with other types and kinds of supply materials that are edible and non-edible. In an exemplary embodiment, the supply material 302 can be food and can be referred to as food 302. Such food 302 can be dry pet food.

In an exemplary embodiment, lid 102 is sized to cover collar 104. Better illustrated in at least FIGS. 4 and 12, lid 102 comprises a first interlocking row of ridges 118 integrally formed along one perimeter edge. The collar 104 comprises a second interlocking row of ridges 142 integrally formed along one perimeter edge. The first interlocking row of ridges 118 and the second interlocking row of ridges 142 are movably interconnected such that lid 102 can be opened by user 402 to access the supply material 302 within the container interior region. And closed to cover the supply material 302 within the container interior region 144.

In operation, the weight of supply material 302 added to the movable tray 106 causes the movable tray 106 to descend 204 into the container tower 152, tensioning by stretching the elastic bands 126. Then when a portion of supply material 302 is removed reducing the weight on the movable tray 106, the movable tray 106 ascends 204 up the container tower 152 by way of tension in the elastic bands 126 lifting the remaining portion of supply material 302 on the movable tray 106. In this regard, supply material 302 is always accessible to user 402 proximate to the container top 148 regardless of the amount of supply material 302 remaining on the movable tray 106 within the self-lifting supply container 100.

The elastic bands 126 can be surgical tubing, other types of elastic type tubing, or other types and/or kinds of elastic bands 126, as may be required and/or desired in a particular embodiment.

The number of elastic bands 126 used and the stretchability and/or elasticity force of the elastic bands 126 are selected to counteract the weight of the supply material 302 as it is added and/or removed from the movable tray 106 within the self-lifting supply container 100. In this regard, the number of elastic band 126 used and the tension underload of the elastic band 126 is selected so that the weight of the supply material 302 when added to the movable tray 106 causes the movable tray 106 to descend into the self-lifting supply container 100 until the movable tray 106 reaches the bottom plate 116.

Conversely, as the supply material 302 is removed or otherwise scooped out of the self-lifting supply container 100 by user 402 the elastic bands 126 contract to raise the movable tray 106 so that no matter how much of the supply material remains in the self-lifting supply container 100 it is easily accessible by user 402 at the top of the self-lifting supply container 100 (no need to reach down into the self-lifting supply container 100 to get the supply material 302).

Based on the weight of the supply material (heavy, medium, light) the parameters of the elastic bands 126 can be changed and or selected which may be different from embodiment to embodiment as needed.

Figure 12:
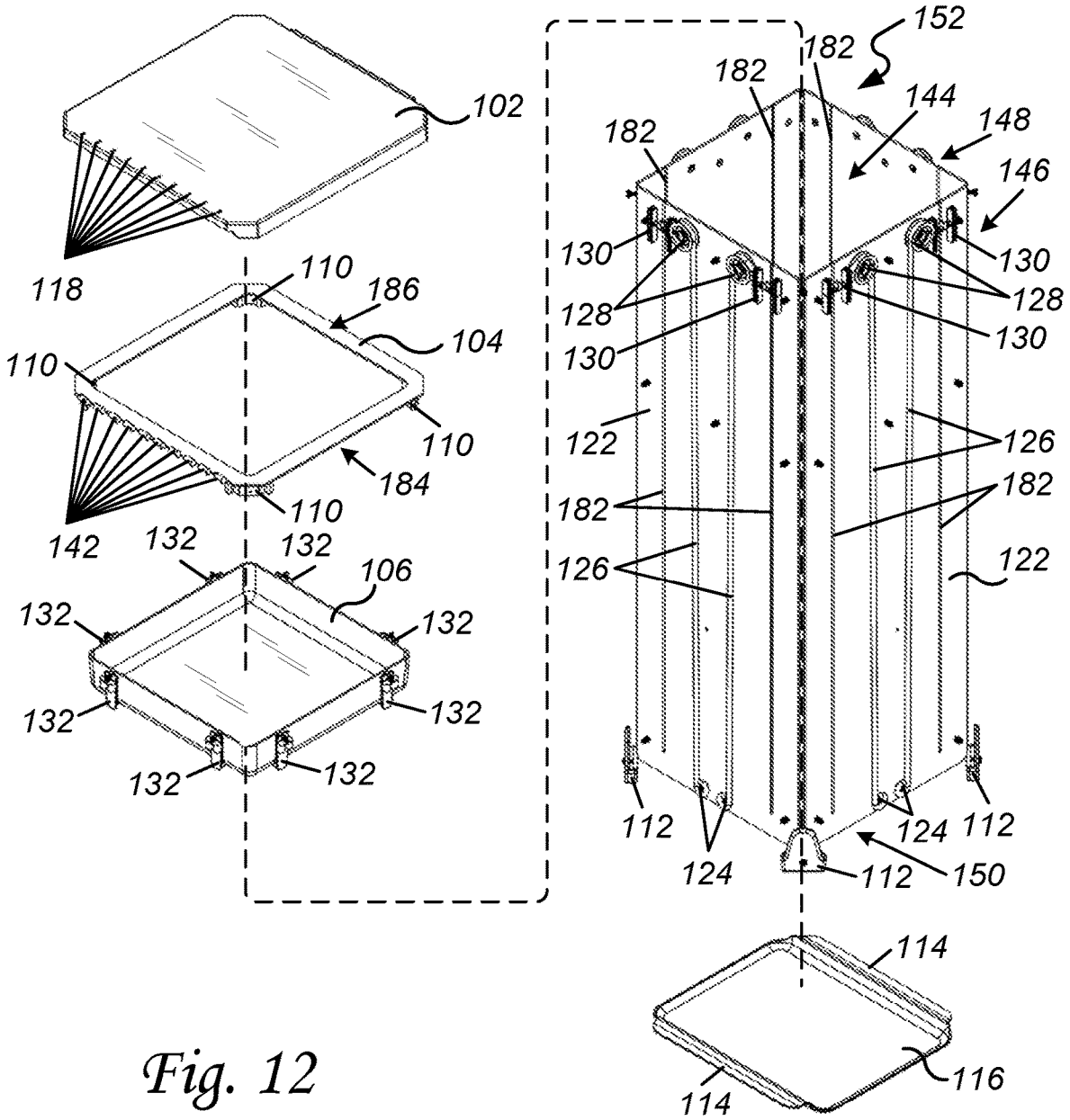
FIGS. 12-14 illustrates one example of an assembly view of a self-lifting supply container.
Figure 15:
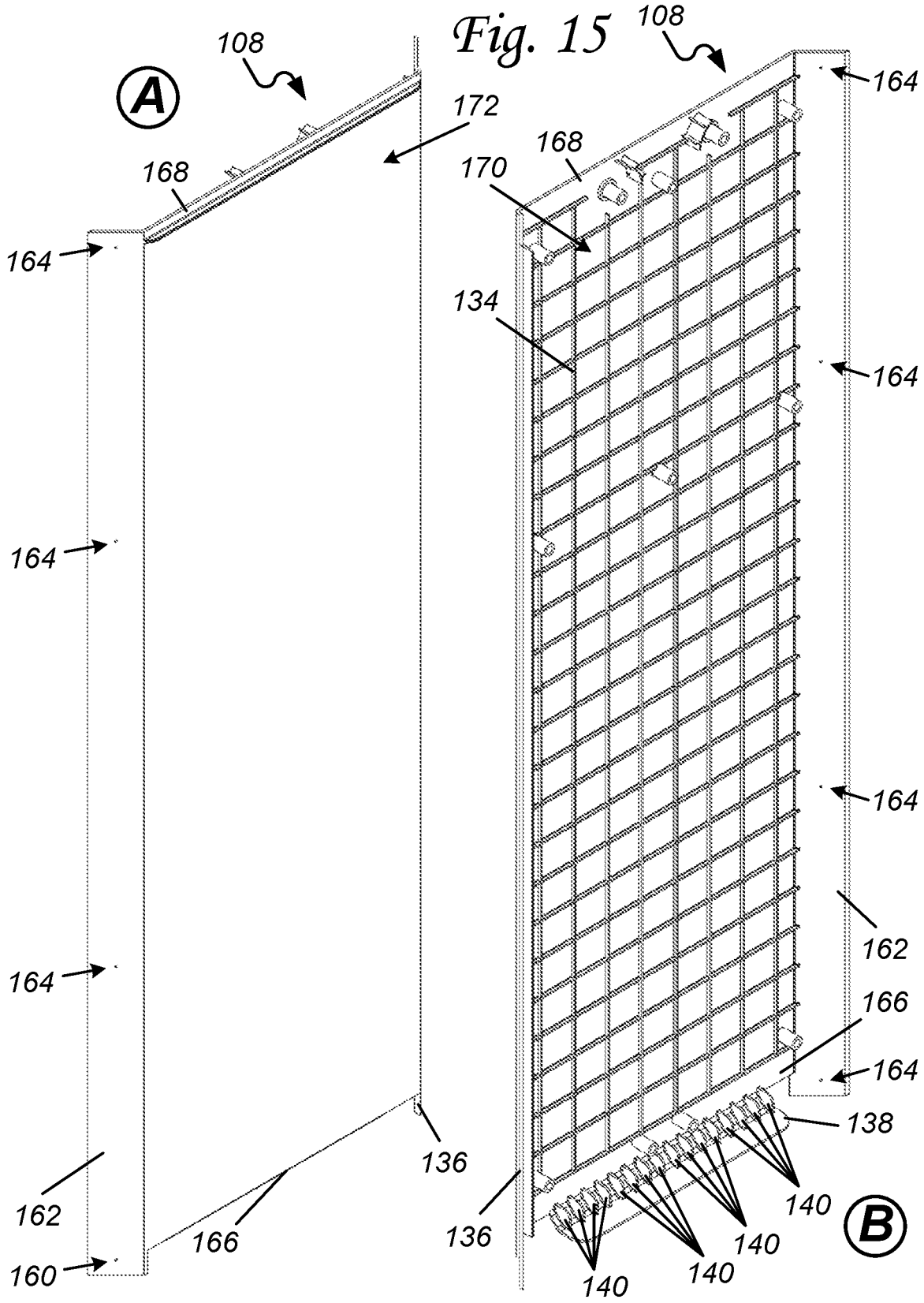
FIGS. 15-16 illustrates one example of a front view and a back view of a panel.

In an exemplary embodiment, and with reference to at least FIGS. 1, 12, and 15, there can be more than one panel 108. Panel 108 can comprise a left panel edge 162, and a right panel edge 136. Each of the left panel edges 162 and the right panel edges 136 have more than one mounting hole 164 therethrough such that panel 108 can be fastened with a fastener 154, such as by a screw or other fastener, to the container wall 122. The left panel edge 162 and the right panel edge 136 can be contoured at a 45-degree angle with respect to the container wall 122, such that panels 108 when fastened completely cover the exterior container surface 146 of the container walls 122 including around the corners to create an aesthetically pleasing self-lifting supply container 100.

In an exemplary embodiment, more than one footer 112 can be formed into a U-shape. As better illustrated in at least FIG. 14, the U-shape creates a panel gap 158. Footer 112 has a footer mounting hole 160 therethrough. The adjacent left panel edge 162 and the right panel edge 136 overlap and slide into the panel gap 158. A footer fastener 156 passes through the footer mounting hole 160 securing the footer 112 to panels 108.

The self-lifting supply container 100 can be fabricated from plastic, metal, elastomers, a combination thereof, or other types and/or kinds of material as may be required and/or desired in a particular embodiment.

Figure 2:
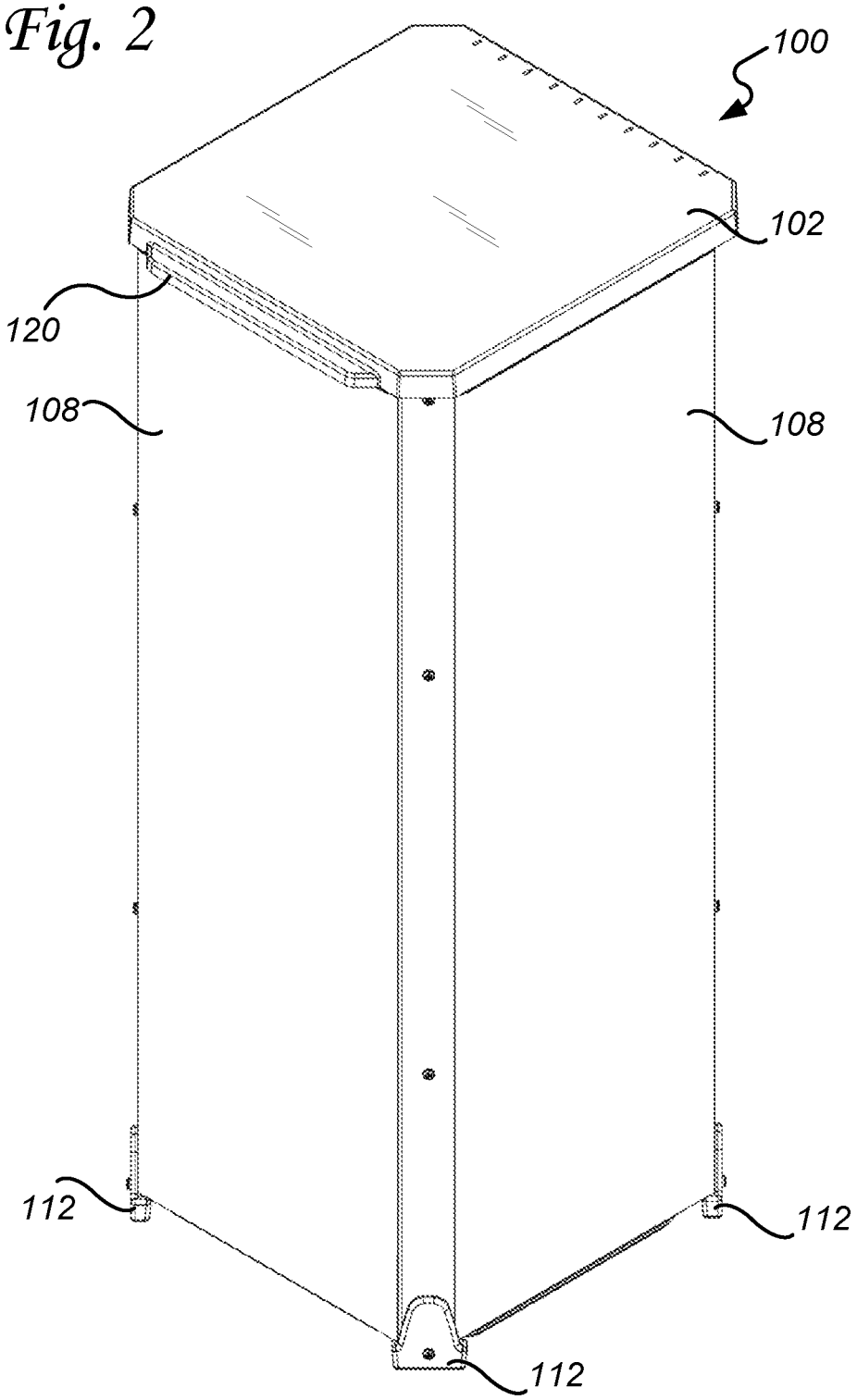
FIG. 2 illustrates one example of a self-lifting supply container with a closed lid.

Referring to FIG. 2, there is illustrated one example of a self-lifting supply container 100 with a closed 202 lid 102. In an exemplary embodiment, the lid 102 can comprise a lifting tab 120 that is integrally formed along a perimeter edge. In operation, user 402 can place a finger underneath the lifting tab 120 to more easily open 202 the lid 102.

Figure 3:
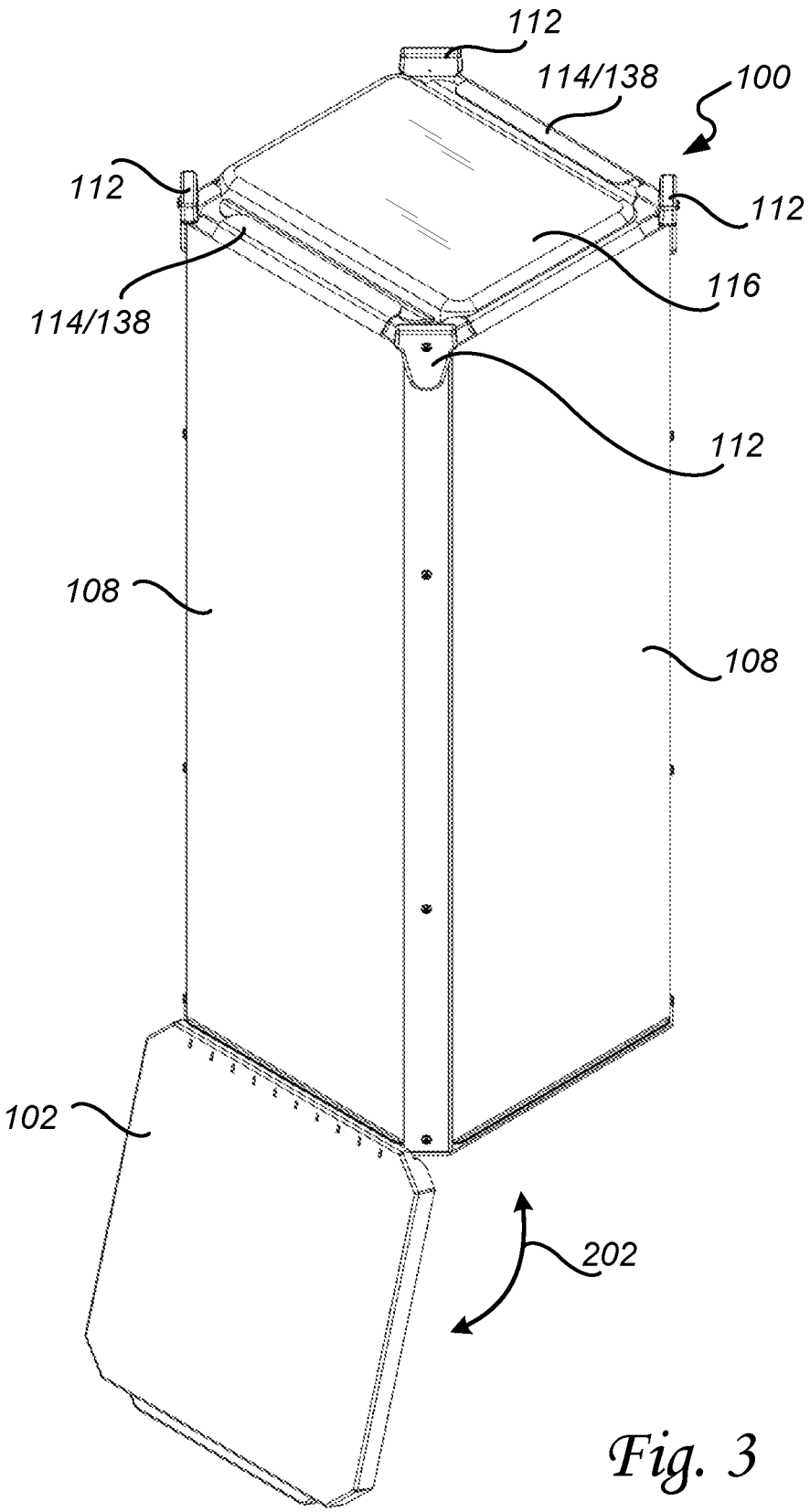
FIG. 3 illustrates one example of a bottom perspective view of a self-lifting supply container with an open lid.
Figure 17:
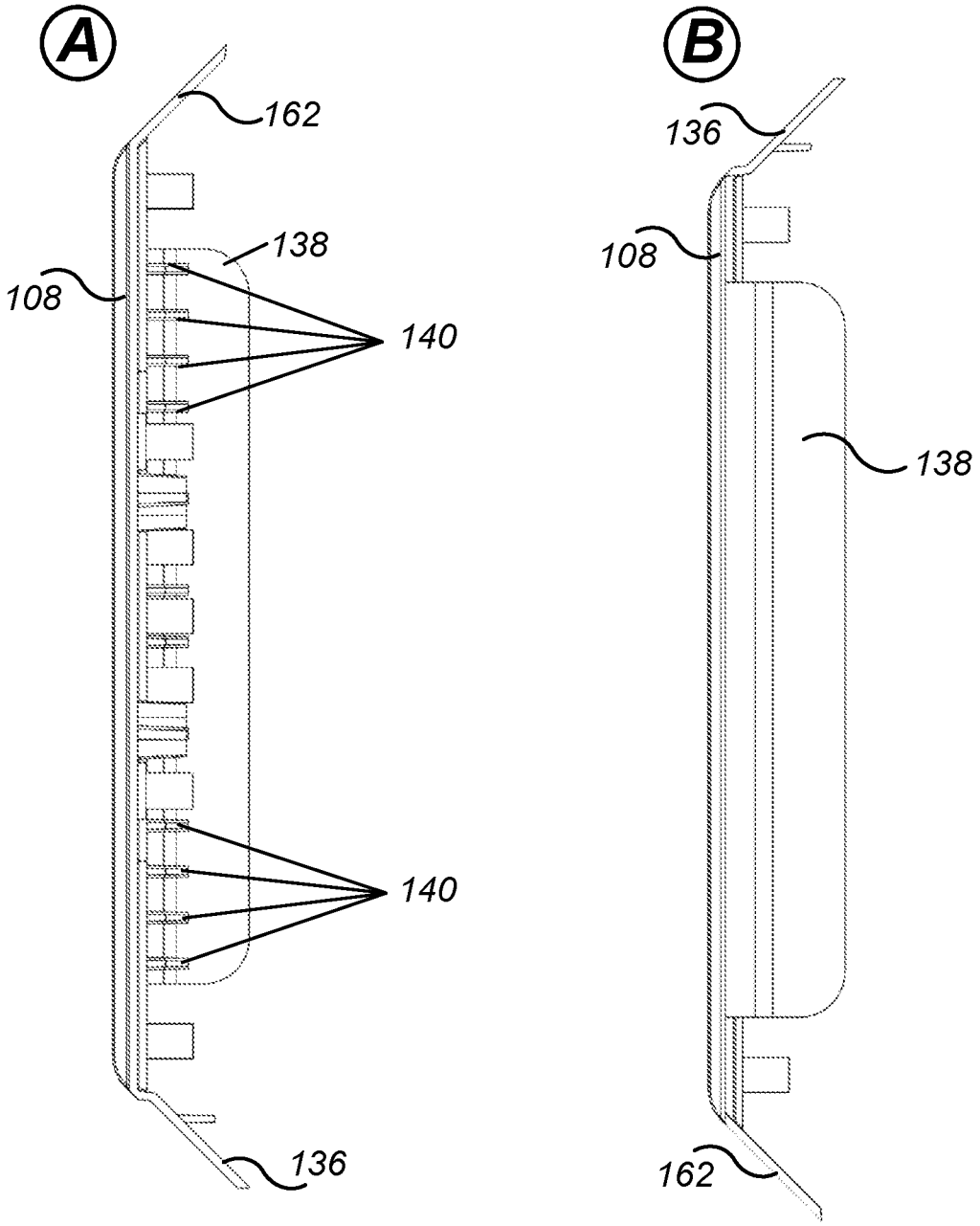
FIG. 17 illustrates one example of a top view and a bottom view of a panel.

Referring to FIG. 3 there is illustrates one example of a bottom perspective view of a self-lifting supply container 100 with an open lid 102. Referring to FIG. 17, there is illustrated one example of a top view in reference 'A' and a bottom view in reference 'B of panel 108.

Figure 16:
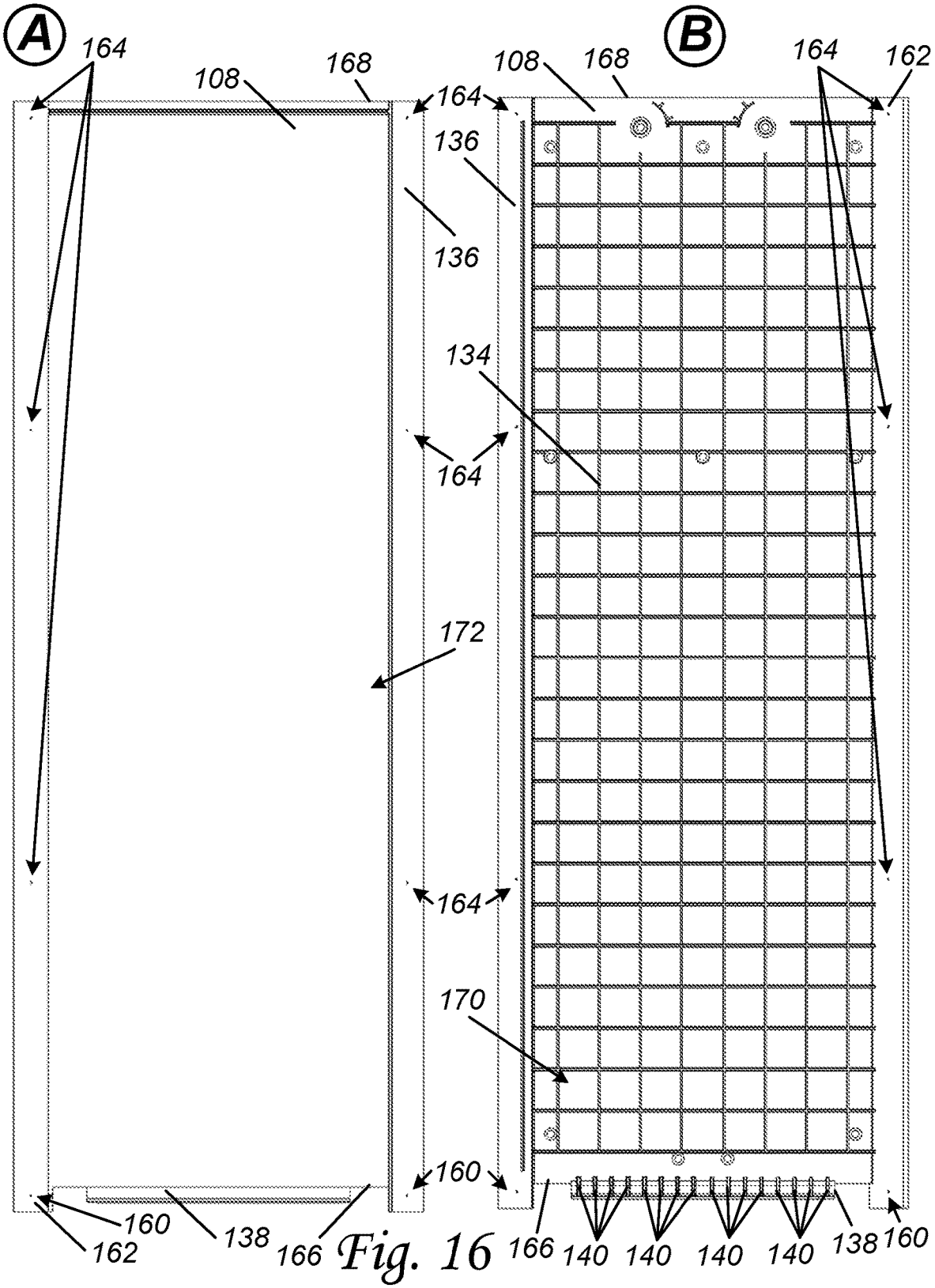

In an exemplary embodiment, and with reference to at least FIGS. 3, 12, and 16 a panel contoured lip 138 can be formed on the panel bottom edge 166 on at least two of the panels 108 that are opposed when assembled into the container tower 152. A bottom plate 116 can comprise a contoured lip 114 on at least two opposing perimeter edges. The contoured lip engages the top surface of the panel contoured lip 138 securing the bottom plate 116 proximate to the bottom of the container tower 152, and spanning the container interior region 144.

In an exemplary embodiment, more than one strengthening rib 140 can be integrally formed in a row along the union between the interior panel surface 170 and the panel contoured lip 138.

Figure 4:
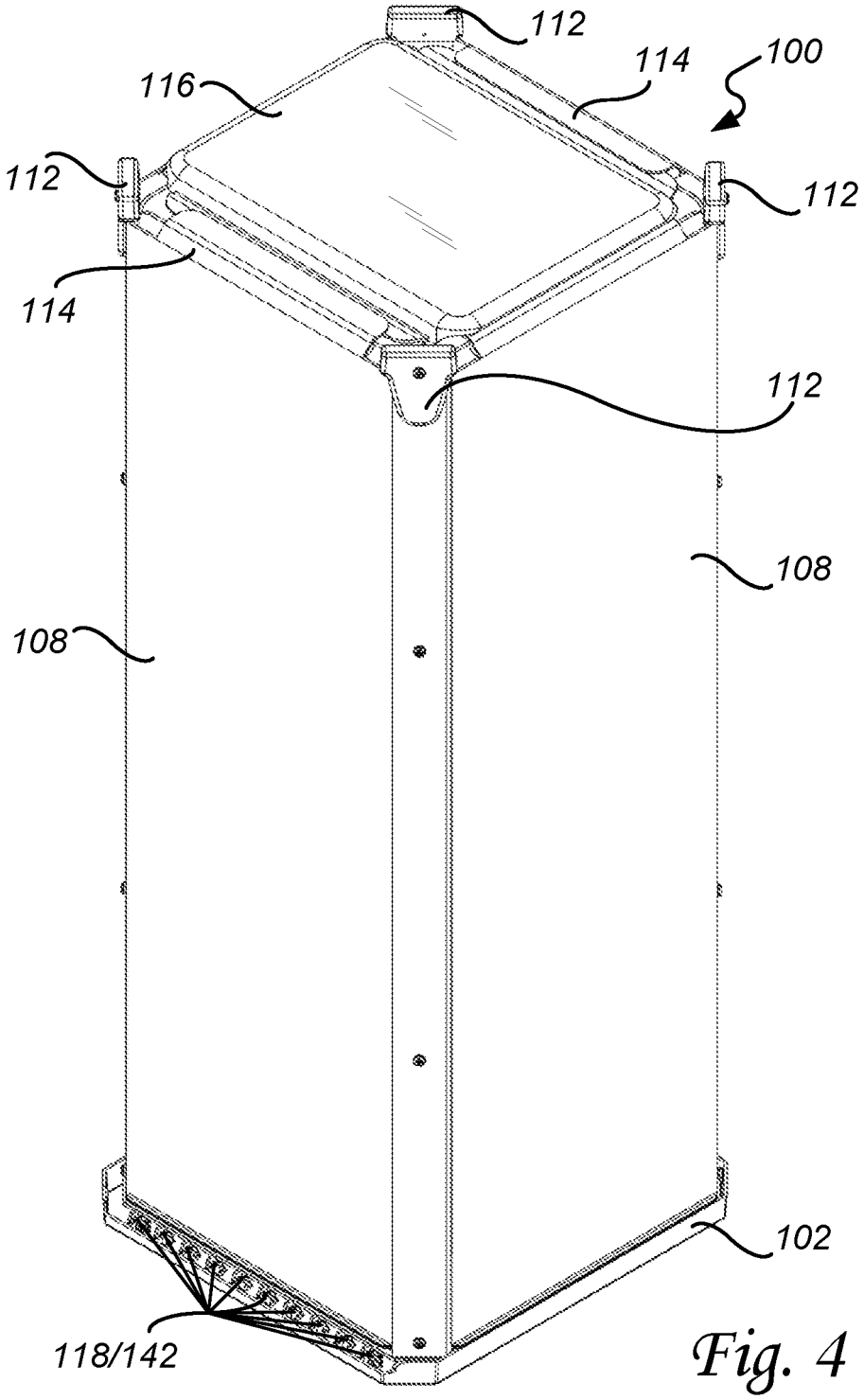
FIG. 4 illustrates one example of a bottom perspective view of a self-lifting supply container with a closed lid.

Referring to FIG. 4, there is illustrated one example of a bottom perspective view of a self-lifting supply container 100 with a closed lid 102. In an exemplary embodiment, viewable is the first interlocking row of ridges 118 and the second interlocking row of ridges 142 are movably interconnected such that the lid 102 can be opened 202 by user 402 to access the supply material 302 within the container interior region 144, and closed 202 to cover the supply material 302 within the container interior region 144.

Figure 5:
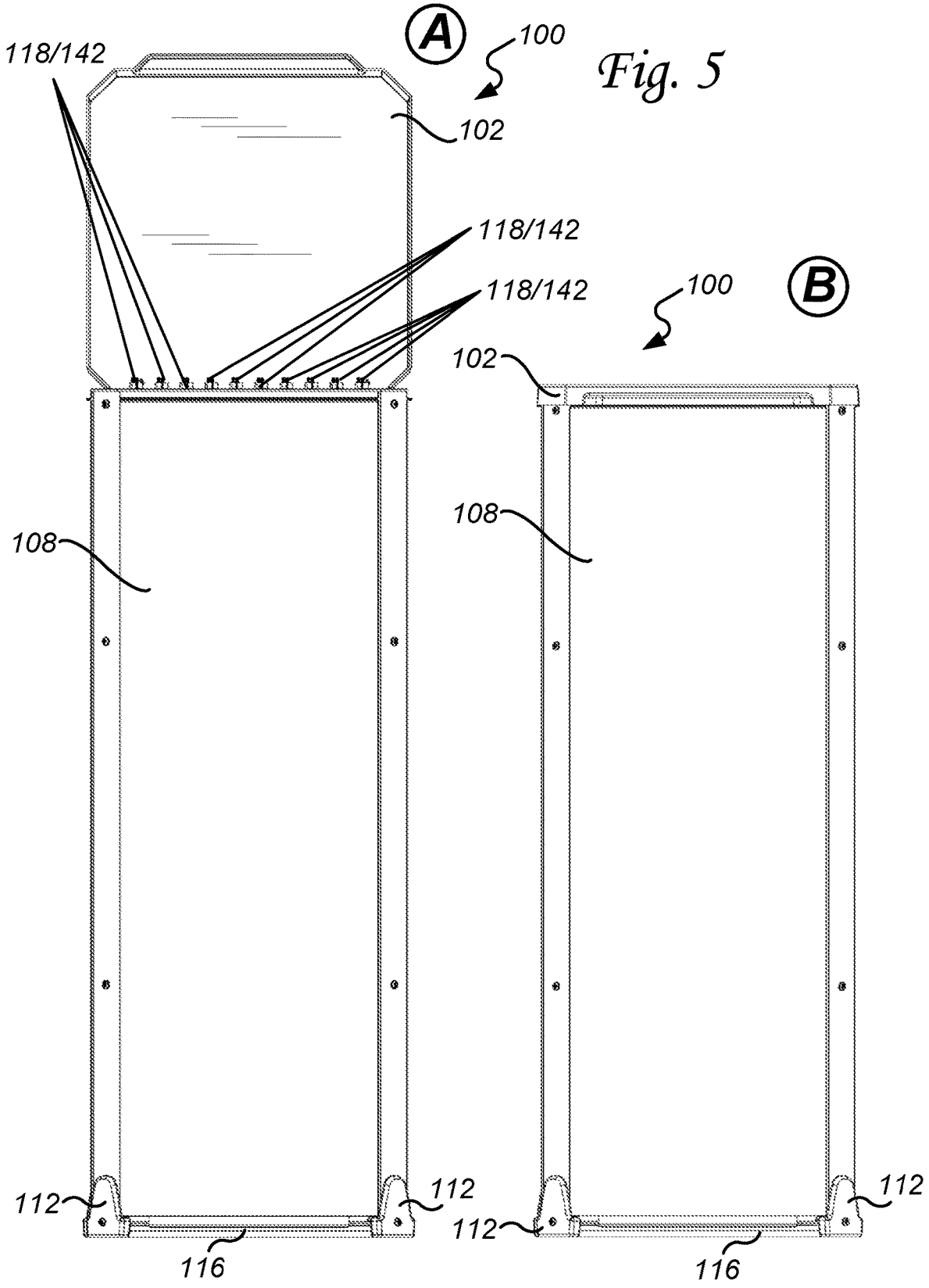
FIG. 5 illustrates one example of front views of a self-lifting supply container with an open lid and a closed lid.
Figure 6:
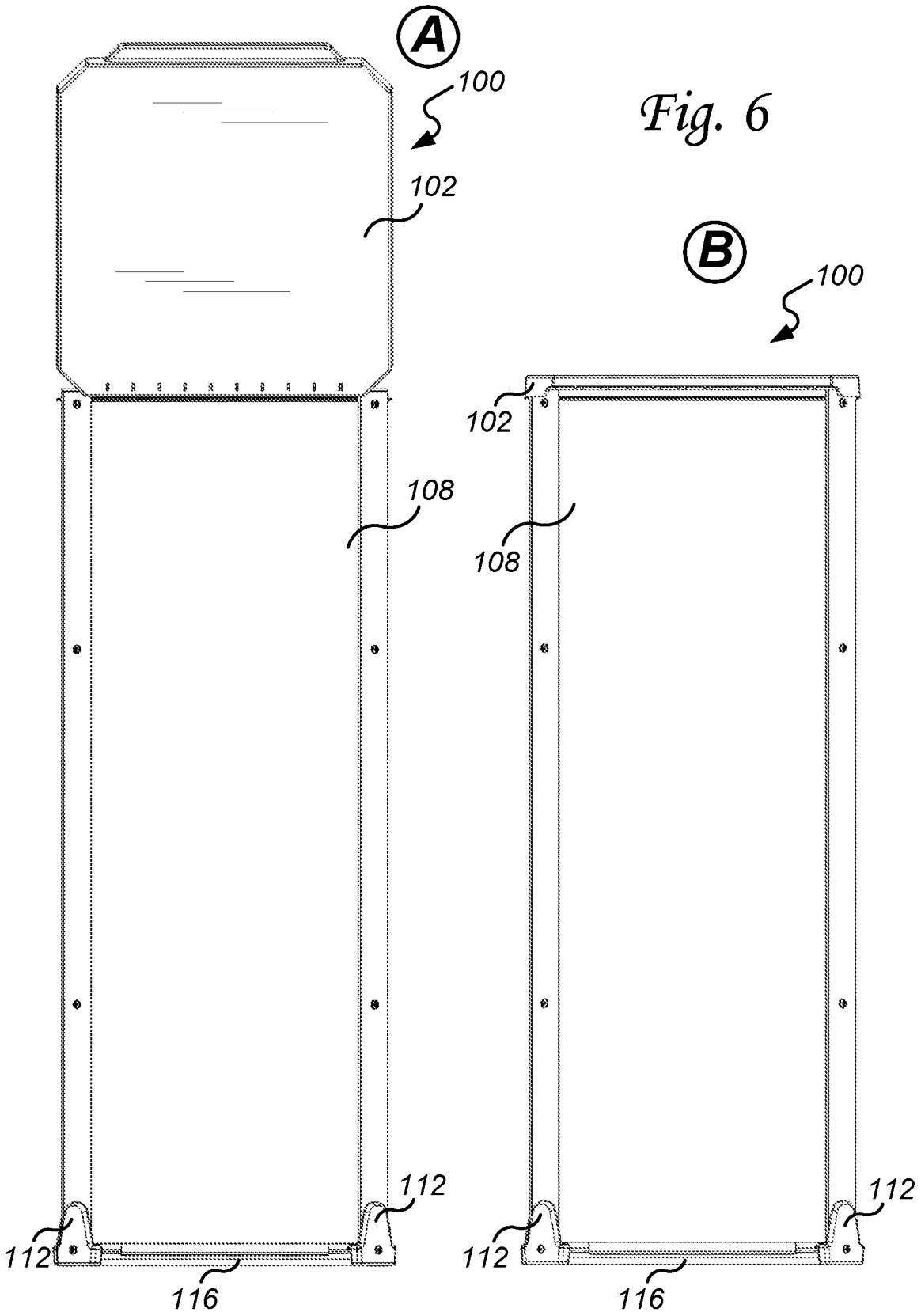
FIG. 6 illustrates one example of back views of a self-lifting supply container with an open lid and a closed lid.
Figure 7:
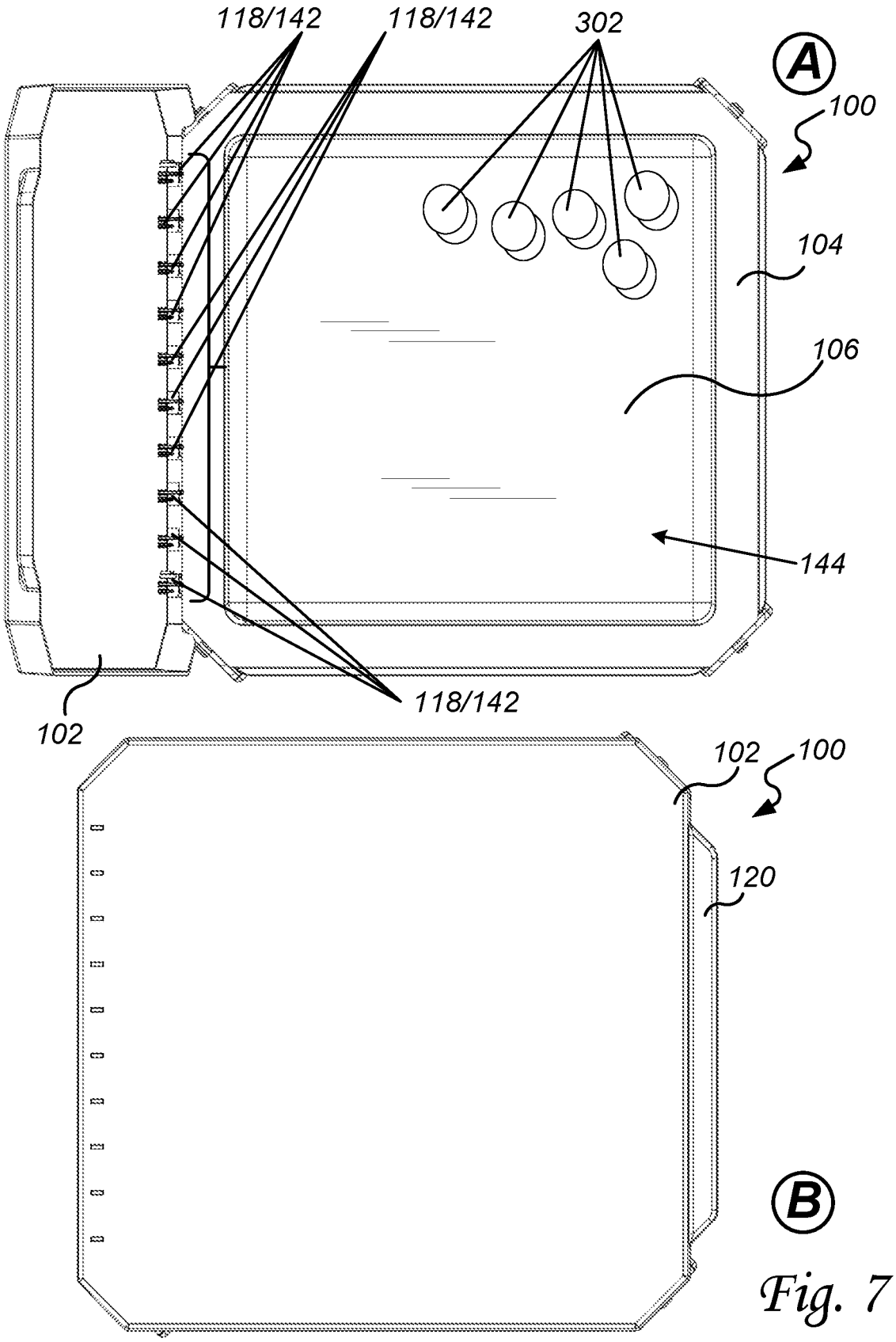
FIG. 7 illustrates one example of top views of a self-lifting supply container with an open lid and a closed lid.
Figure 8:
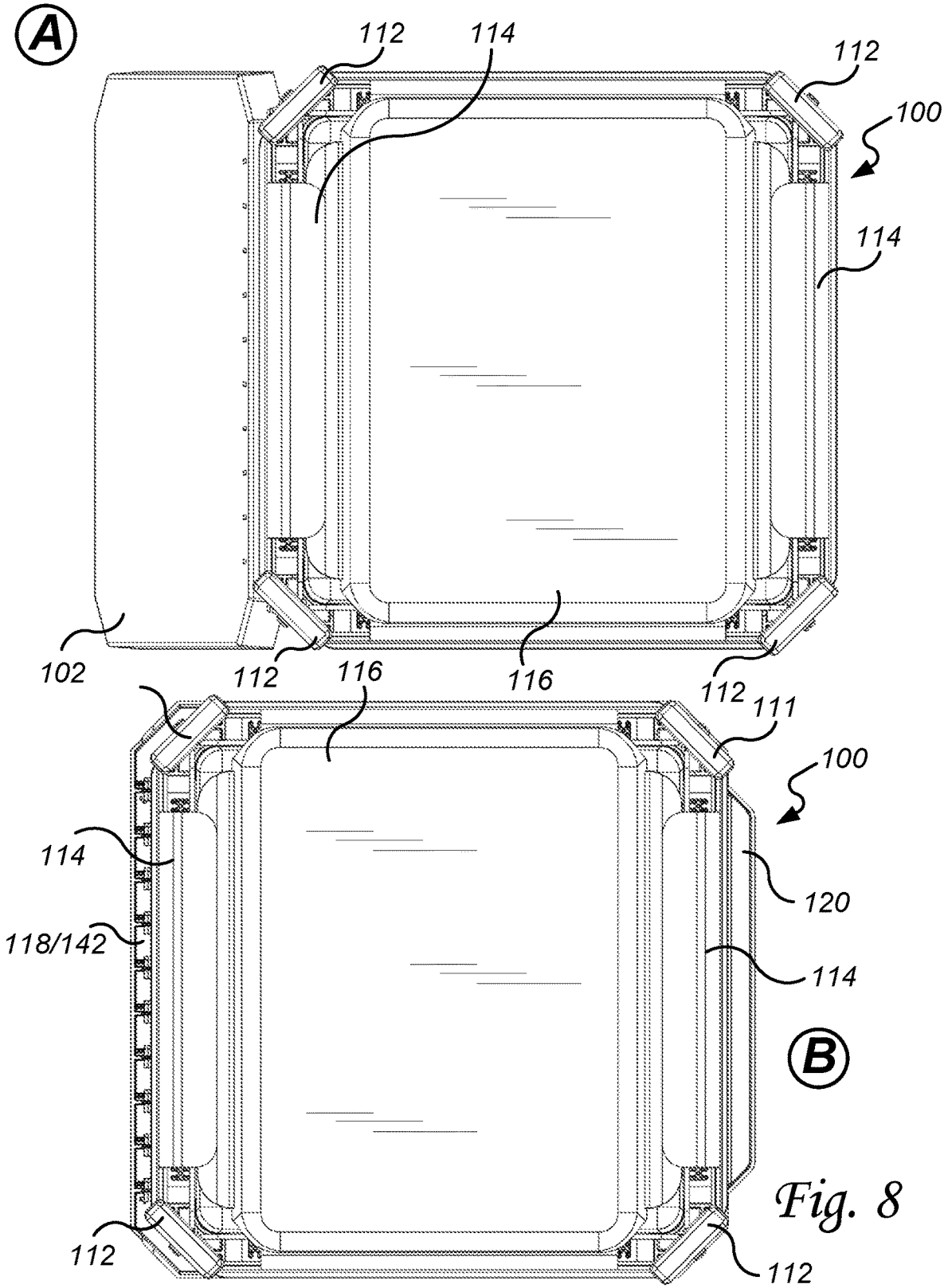
FIG. 8 illustrates one example of bottom views of a self-lifting supply container with an open lid and a closed lid.
Figure 9:
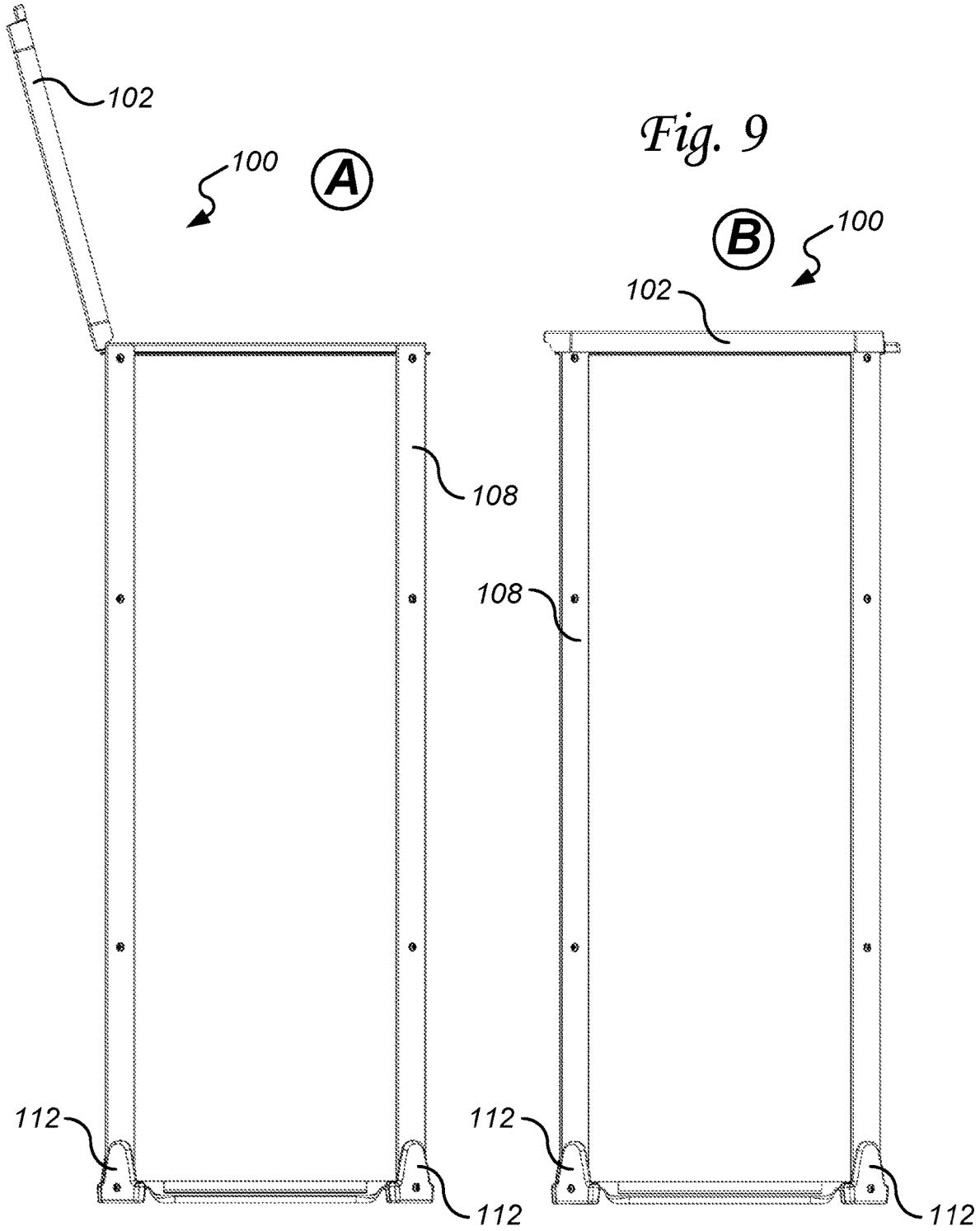
FIG. 9 illustrates one example of a left side views of a self-lifting supply container with an open lid and a closed lid.
Figure 10:
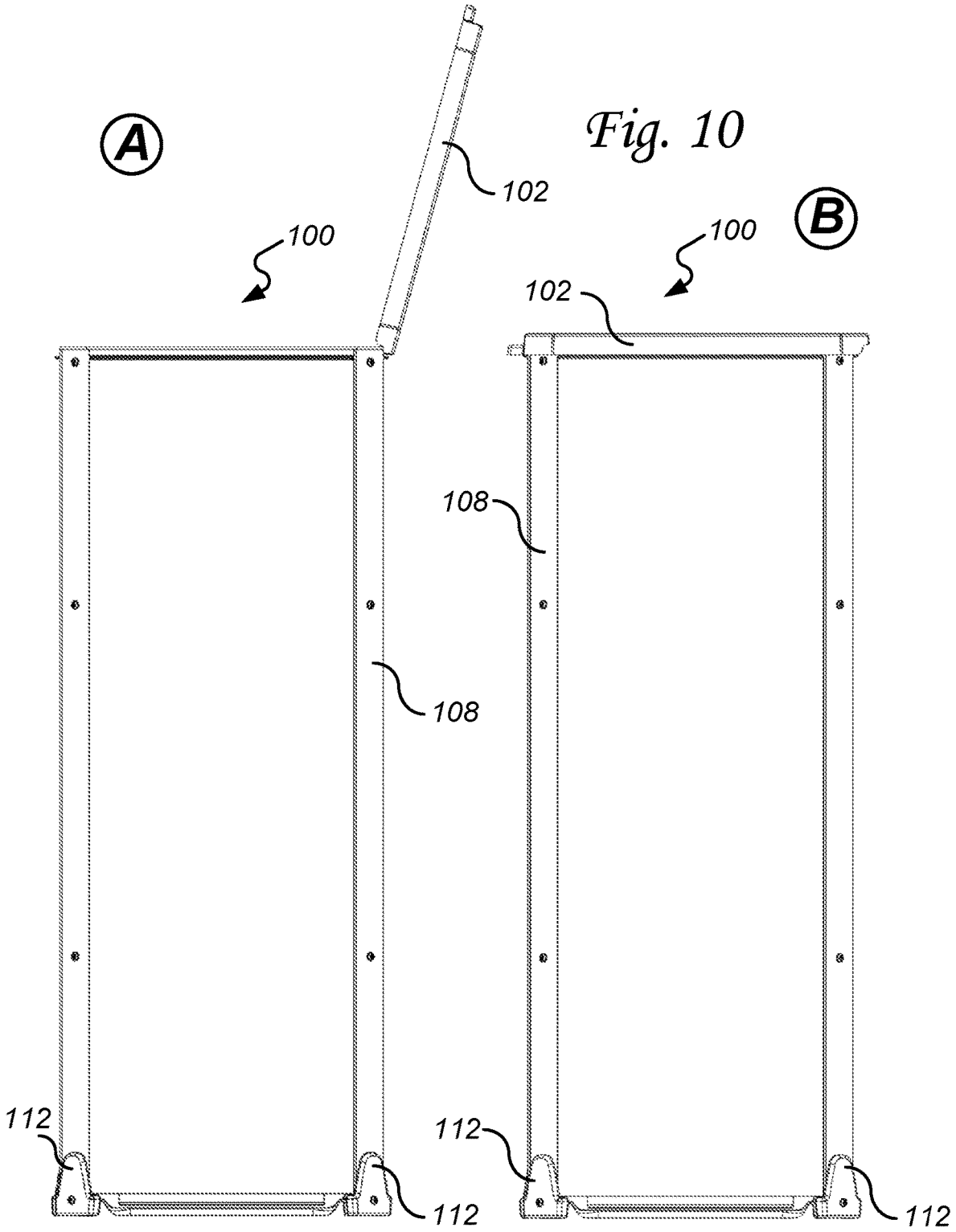
FIG. 10 illustrates one example of a right side views of a self-lifting supply container with an open lid and a closed lid.

Referring to FIG. 5, there is illustrated one example of front views of a self-lifting supply container 100 with an open lid 102 in reference 'A' and a closed lid 102 in reference 'B'. Referring to FIG. 6, there is illustrated one example of back views of a self-lifting supply container 100 with an open lid 102 in reference 'A', and a closed lid 102 in reference 'B'. Referring to FIG. 7 there is illustrated one example of top views of a self-lifting supply container 100 with an open lid 102 in reference 'A', and a closed lid 102 in reference 'B'. Referring to FIG. 8, there is illustrated one example of bottom views of a self-lifting supply container 100 with an open lid 102 in reference 'A', and a closed lid 102 in reference 'B'. Referring to FIG. 9, there is illustrated one example of a left side views of a self-lifting supply container 100 with an open lid 102 in reference 'A', and a closed lid 102 in reference 'B'. Referring to FIG. 10, there is illustrated one example of a right side views of a self-lifting supply container 100 with an open lid 102 in reference 'A', and a closed lid 102 in reference 'B'.

Figure 11:
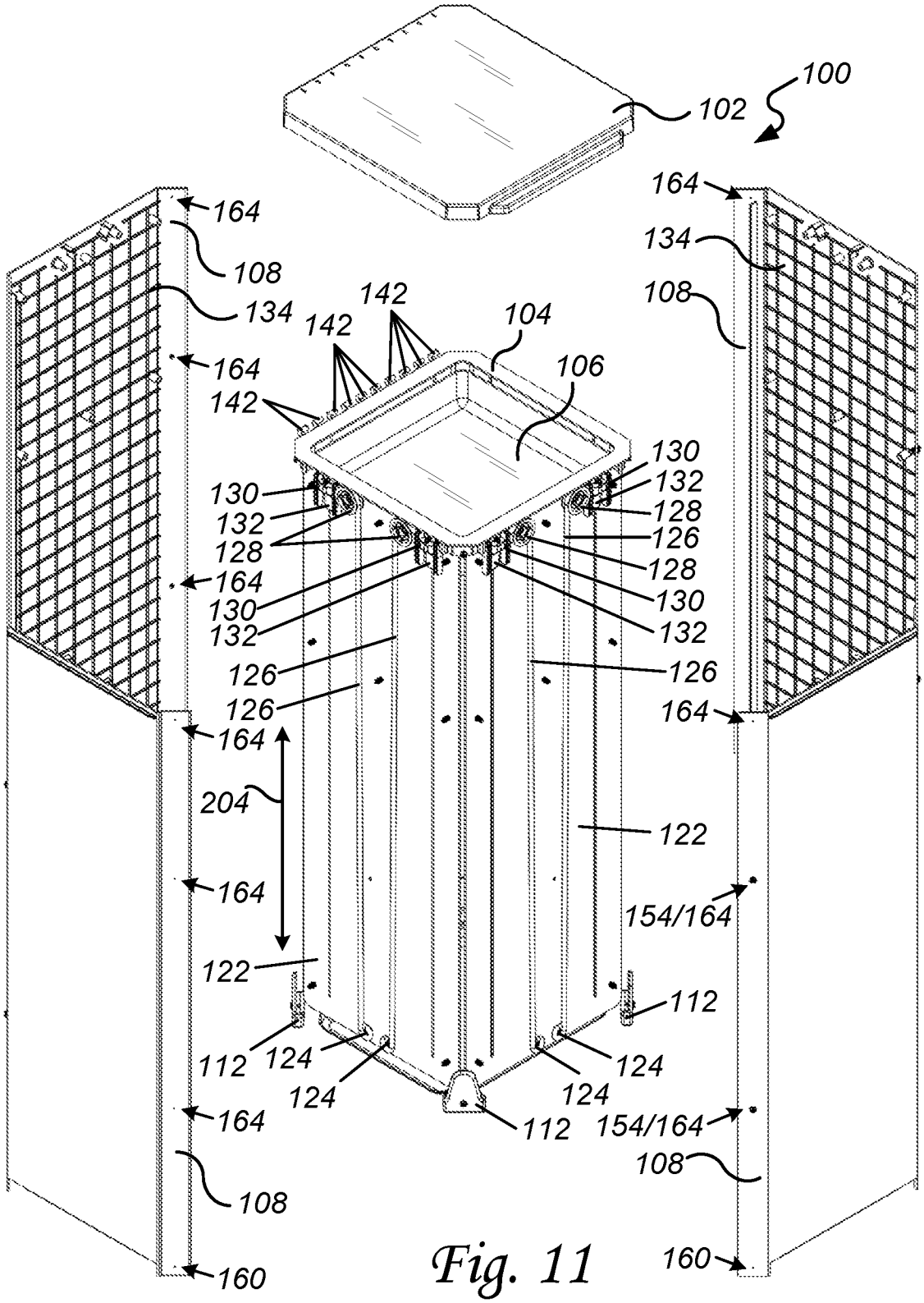
FIG. 11 illustrates one example of a disassembled view of a self-lifting supply container.
Figure 19:
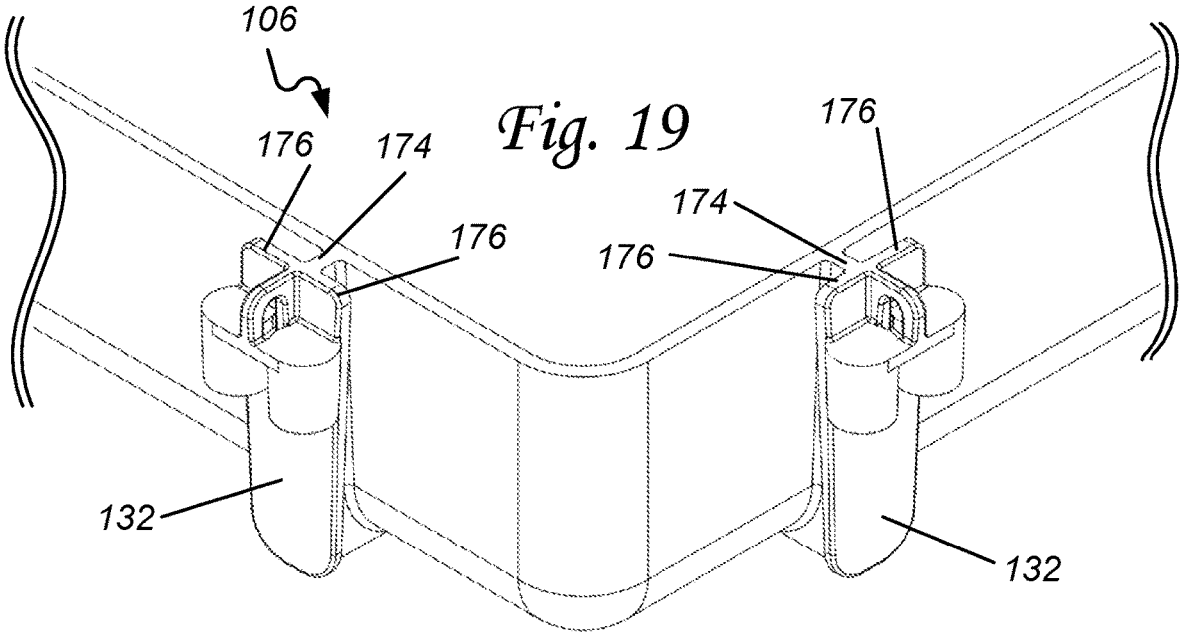
FIG. 19 illustrates one example of a guide on a movable tray.

Referring to FIG. 11, there is illustrated one example of a disassembled view of a self-lifting supply container 100. Referring to FIG. 12, there is illustrated one example of an assembly view of a self-lifting supply container 100. Referring to FIG. 19, there is illustrated one example of guide 132 on a movable tray 106. In an exemplary embodiment, the self-lifting supply container 100 comprises a movable tray 106, at least one of a guide 132, more than one of a container wall 122, at least one of a pulley 128, and more than one of an elastic band 126. In this regard, at least one guide 132 is fastened to each side of the outer perimeter of the movable tray 106. With reference to at least FIG. 19, guide 132 can comprise a body portion 174 that is narrow and a head portion 176 that is connected to and wider than the body portion 174.

In an exemplary embodiment, there is more than one container wall 122 and each of the container wall 122 has at least one track 182 cut therethrough. As better illustrated in at least FIG. 12, each of the container walls 122 is secured proximate to each other forming a container tower 152. The container tower 152 has a container top 148, a container bottom 150, an interior container region 144, and an exterior container surface 146. Track 182 is orientated vertically running substantially from the container top 148 to proximate the container bottom 150, the movable tray 106 is sized to fit within the interior container region 152 with the body portion 174 of guide 132 fitting through the track and the head portion 176 of guide 132 positioned proximate to the exterior container surface 146 retaining the movable tray 106 within the interior container region 144 and allowing the movable tray 106 to slide up and down the track 182 within the interior container region 144.

More than one pulley 128 is secured on the exterior container surface 146 of each of the container walls 122 proximate to the container top 148. And, the self-lifting supply container 100 comprises more than one elastic band 126. One end of each elastic band 126 is attached 124 to the exterior container surface 146 of the container wall 122 proximate to the container bottom 150, and the other end of the elastic band 126 passes over the pulley 132 and is secured to the guide 132.

In an exemplary embodiment, in operation, the weight of supply material 302 added to the movable tray 106 causes the movable tray 106 to descend 204 into the container tower 152, tensioning by stretching the elastic bands 126. When the user removes a portion of the supply material 302 reducing the weight on the movable tray 106, the movable tray 106 partially ascends 204 the container tower 152, by way of tension in the elastic band 126, lifting the movable tray 106 and supply material 302 on the movable tray 106. In this regard, supply material 302 is accessible to user 402 proximate to the container top 148 regardless of the amount of supply material 302 remaining on the movable tray 106 within the interior container region 144 of the self-lifting supply container 100.

Figure 13:
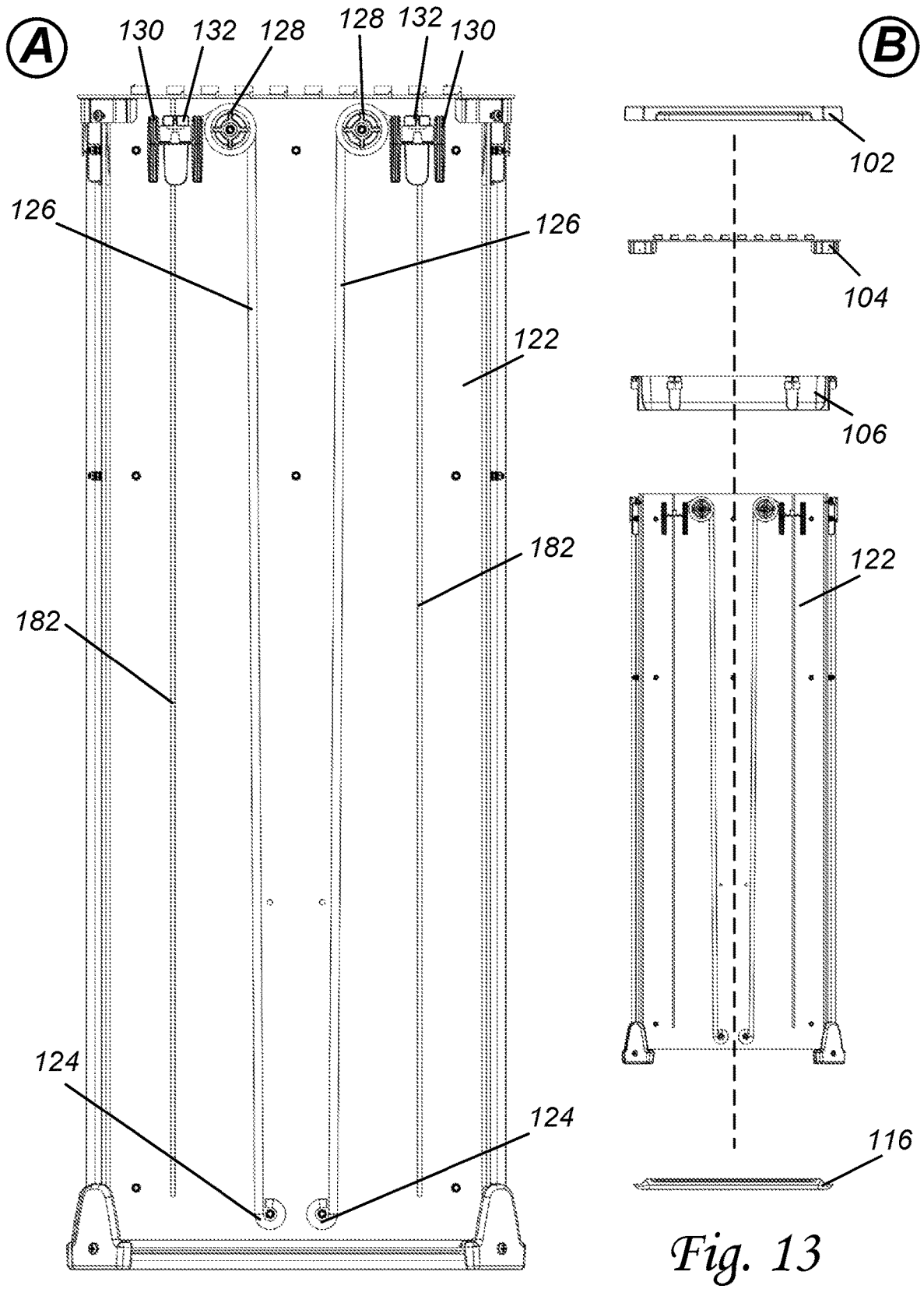
Figure 14:
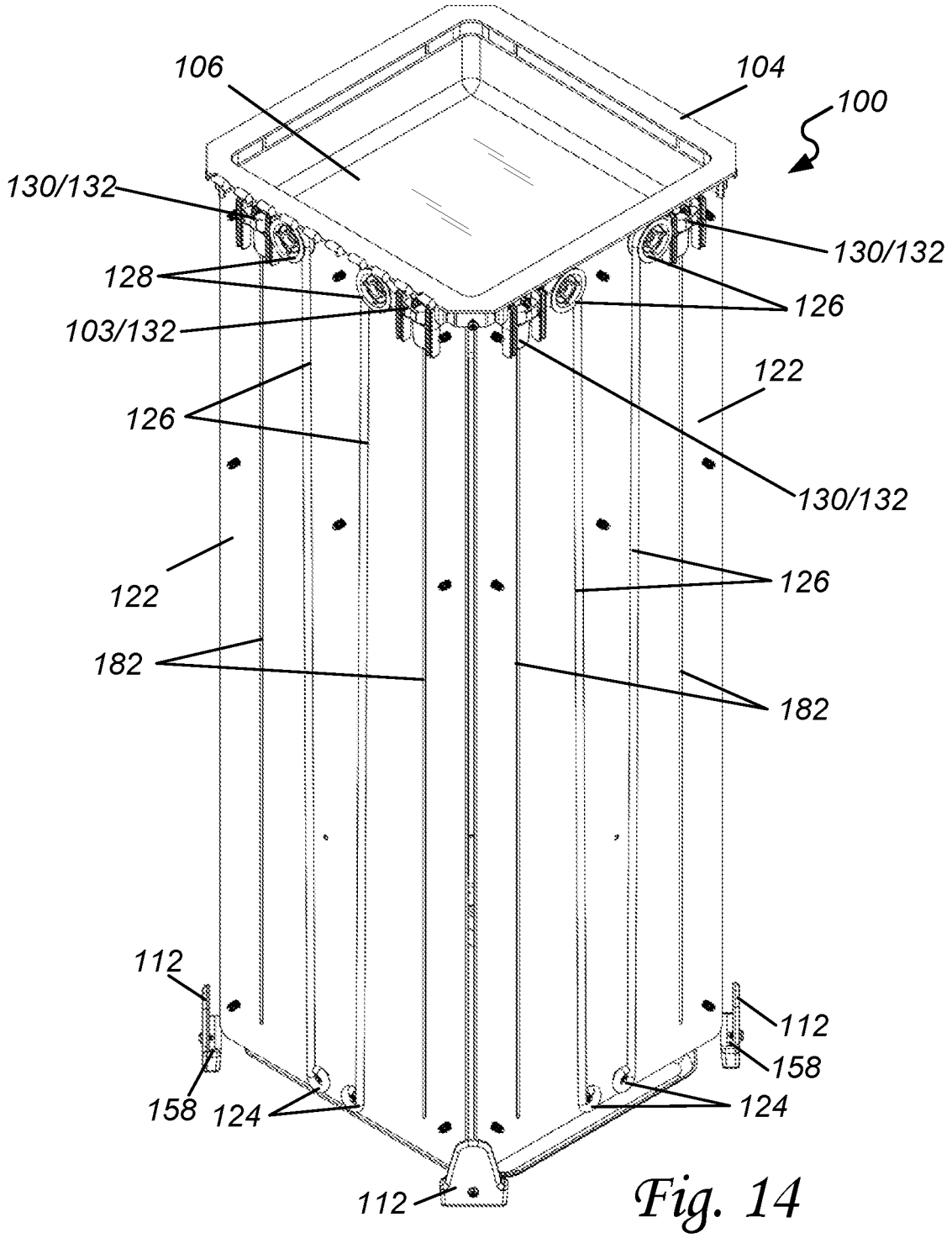

Referring to FIGS. 13 and 14, there is illustrated one example of an assembly view of a self-lifting supply container 100. In an exemplary embodiment, there are two tracks 82, two pullies 128, and two elastic bands 126 on each of four of the container walls 122 that are secured together to form the container tower 152.

In an exemplary embodiment, at least one track spanning guide stop 130 can be fastened across track 182 proximate to the container top 148. The track spanning guide 130 secures the loose edges of track 182 from motion and blocks guide 132 from being removable from track 182.

In an exemplary embodiment, each pulley 128 can be positioned proximate to a track 182 and have a dedicated guide 132 and elastic band 126. In this regard, to better ensure that the movable tray 106 moves smoothly up and down the tracks 182 without binding there can be more than one pulley 128, track 182, guide 132, and elastic band 126 on each container wall 122. In this regard, FIG. 13 illustrates how two pulleys 128, two tracks 182, two guides 132, and two elastic bands 126 can be configured on each container wall 122 to keep the movable tray 106 level and smoothly descending and ascending 202 without binding as supply material 302 is added and removed from the self-lifting container 100.

In another exemplary embodiment, a self-lifting supply container 100 comprises a movable tray 106, and at least one guide 132 that is fastened to each side of the outer perimeter of the movable tray 106. The guide 132 comprises a body portion 174 that is narrow and a head portion 176 that is connected to and wider than the body portion 174.

The self-lifting supply container 100 further comprises more than one container wall 122. Each of the container walls 122 has at least one track 182 cut therethrough. Each of the container walls 122 is secured proximate to each other forming a container tower 152. The container tower 152 has a container top 148, a container bottom 150, an interior container region 144, and an exterior container surface 146. The track 182 is orientated vertically running substantially from the container top 148 to proximate the container bottom 150. The movable tray 106 is sized to fit within the interior container region 144 with the body portion 174 of the guide 132 fitting through the track 182 and the head portion 175 of the guide positioned proximate to the exterior container surface 146 retaining the movable tray 106 within the interior container region 144 and allowing the movable tray 106 to slide up and down the track 182 within the interior container region 144.

The self-lifting supply container 100 further comprises pulleys 128 that are secured on the exterior container surface 146 of each of the container walls 122 proximate to the container top 148 and more than one elastic band 126. One end of each of the elastic band 126 is attached to the exterior container surface 146 of the container wall 122 proximate to the container bottom 150, and the other end of the elastic band 126 passes over the pulley 122 and is secured to the guide 132.

The self-lifting supply container 100 further comprises a lid 102. The lid 102 comprises a first interlocking row 118 of ridges integrally formed along one perimeter edge and a collar 104 that is sized to fit the perimeter of the container tower and fastens to the container top. The collar has a top collar surface and a bottom collar surface. Lid 102 is sized to cover the collar 104. The collar 104 comprises a second interlocking row of ridges 142 integrally formed along one perimeter edge. The first interlocking row of ridges 118 and the second interlocking row of ridges 142 are movably interconnected such that lid 102 can be opened 202 by the user to access a supply material 302 within the container interior region 144, and closed 202 to cover the supply material 302 within the container interior region 144.

The self-lifting supply container 100 further comprises more than one panel 108. Panel 108 comprises a top panel edge 168, a bottom panel edge 166, a left panel edge 162, a right panel edge 136, an exterior panel surface 172, and an interior panel surface 170. At least one of the panels 108 is attached to the exterior container surface 146 of each of the container walls 122. A panel contoured lip 138 is formed on the bottom panel edge 166 on at least two of the panels 108 that are opposed, and a bottom plate 116 comprises a contoured lip 114 on at least two opposing perimeter edges. The contoured lip 114 engages the top surface of the panel contoured lip 138 securing the bottom plate 116 proximate to the bottom of the container tower 152. The bottom plate 116 covers the container bottom 150.

The self-lifting supply container 100 further comprises more than one footer 112 formed into a U-shape. The U-shape creates a panel gap 158. The footer 112 has a footer mounting hole 160 therethrough. The adjacent left panel edge 162 and the right panel edge 136 overlap and slide into the panel gap 158 and a footer fastener 156 passes through the footer mounting hole 160 securing the footer 112 to the panel 108.

In operation, the weight of the supply material 302 added to the movable tray 106 causes the movable tray 106 to descend into the container tower 152, tensioning by stretching the elastic bands 126, and removing a portion of the supply material 302, reducing weight on the movable tray 106 causes the movable tray 106 to partially ascend the container tower 152, by way of tension in the elastic band 126, lifting the movable tray 106 and the supply material 302 on the movable tray 106. In this regard, the supply material 302 is accessible to the user 402 proximate to the container top 148 regardless of the amount of the supply material 302 remaining on the movable tray 106 within the interior container region 144 of the self-lifting supply container 100.

Referring to FIG. 15, there is illustrated one example of a front perspective view in reference 'A' and a back perspective view in reference 'B of panel 108. Referring to FIG. 16, there is illustrated one example of a front view in reference 'A' and a back view in reference 'B of panel 108. In an exemplary embodiment and with reference to at least FIG. 11, the self-lifting supply container can comprise more than one panel 108. Panel 108 can comprise a top panel edge 168, a bottom panel edge 166, a left panel edge 162, a right panel edge 136, an exterior panel surface 172, and an interior panel surface 170. At least one panel 108 is attached to the exterior container surface 146 of each container wall 122.

In an exemplary embodiment, a strengthening weave 134 can be integrally formed on the interior panel surface 170 to increase the rigidity and structural strength of panel 108.

Figure 18:
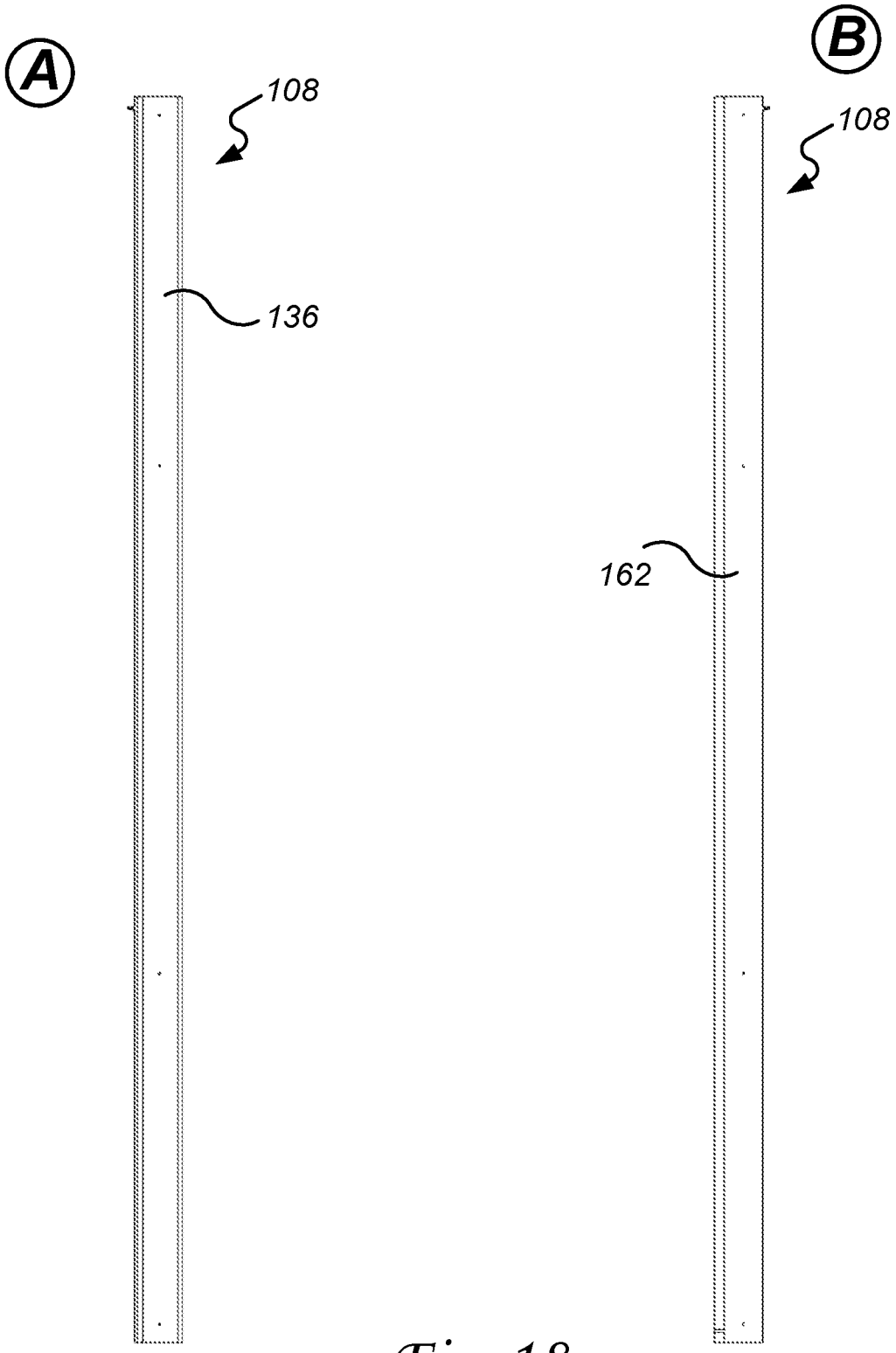
FIG. 18 illustrates one example of a left side view and a right side view of a panel.

Referring to FIG. 18, there is illustrated one example of a left side view in reference 'A' and a right side view in reference 'B' of a panel. In an exemplary embodiment, each of the left panel edge 162 and the right panel edge 136 have more than one mounting hole 164 therethrough such that the panel 106 can be fastened with a fastener 154, such as by a screw or other fastener, to the exterior container surface 146 of the container wall 122, and the left panel edge and the right panel edge are contoured at a 45-degree angle with respect to the container wall 122, such that panels 108 when fastened completely cover the exterior container surface 146 of the container walls 122 including around the corners to create an aesthetically pleasing self-lifting supply container 100.

Figure 20:
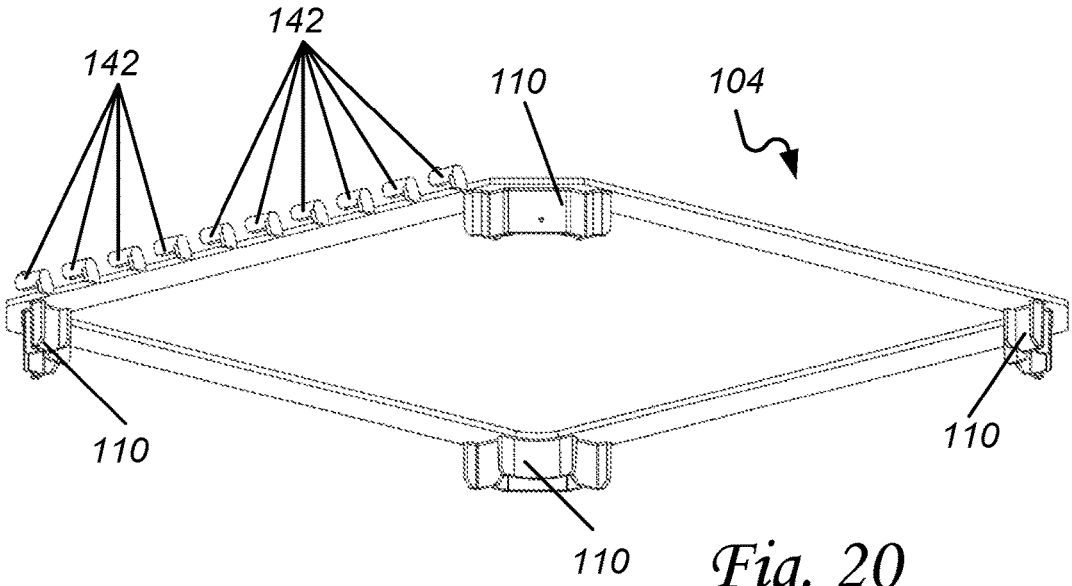
FIGS. 20-21 illustrates one example of a panel alignment mount on a collar.
Figure 21:
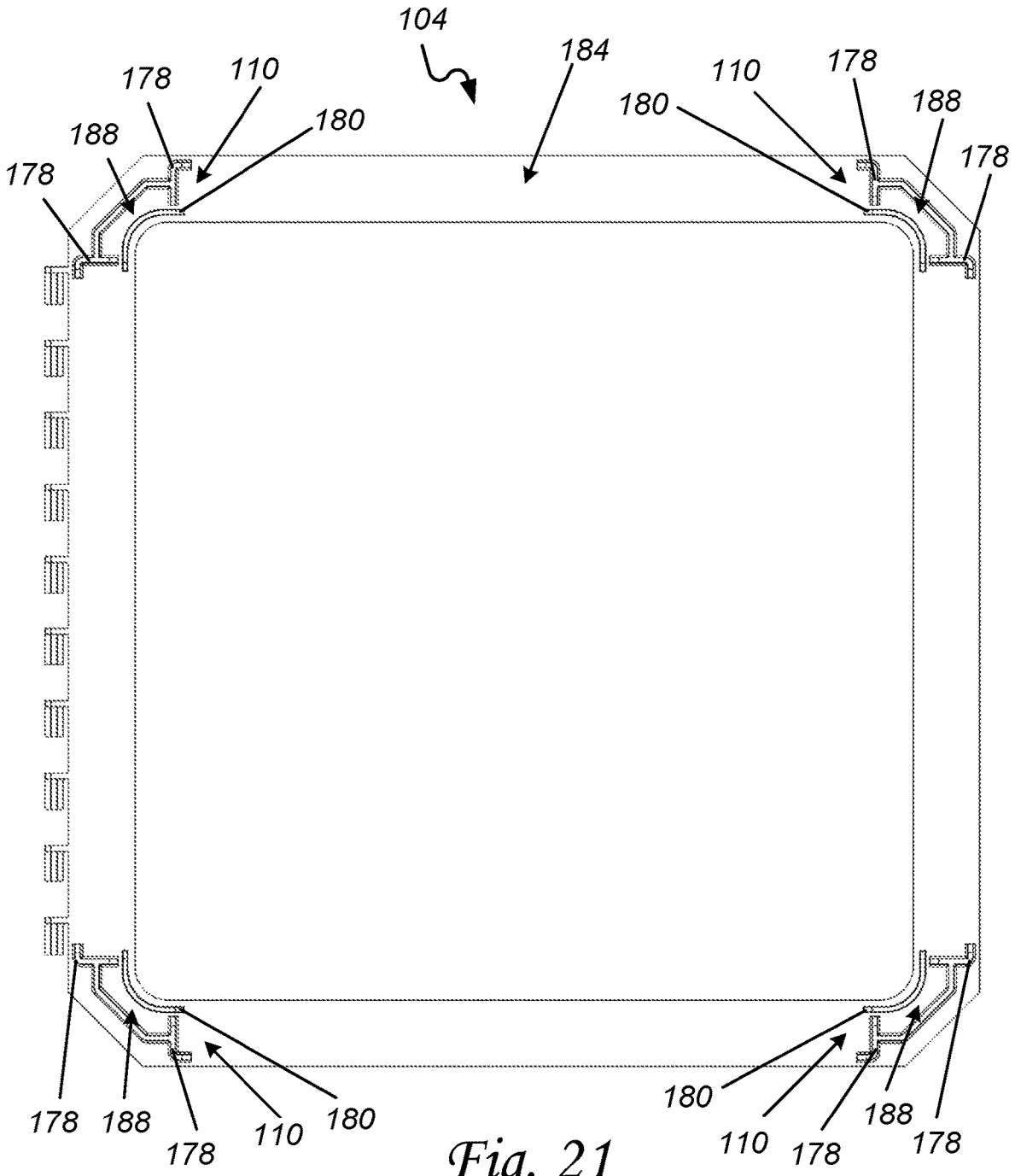

Referring to FIGS. 20 and 21, there is illustrated one example a panel alignment mount 110 on a collar 104. In an exemplary embodiment, collar 104 has a top collar surface 186 (better illustrated in at least FIG. 12) and a bottom collar surface 184. Collar 104 is hollow and sized to fit the perimeter of container tower 152.

The self-lifting supply container 100 further comprises more than one panel alignment mount 110. At least one of the panel alignment mounts 110 is integrally formed on the bottom collar surface 184 at each corner of the collar 104. The collar is 104 fitted on the container top 148 with the panel alignment mount 110 positioned between the exterior container surface 146 and the interior panel surface 170. The collar 104 extends around and secures the edge of the container top 148 of the container wall 122 and the top panel edge 168 of the panel 108.

In an exemplary embodiment, the panel alignment mount 110 can comprise a semicircle ridge 180 and a panel spacing rib 178 each of which is integrally formed on the bottom collar surface 184. The semicircle ridge 180 and the panel spacing rib 178 are separated by a gap 188. Gap 188 is sized in width to allow pulley 128, the elastic band 126, and the guide 132 to operate unencumbered between container wall 122 and panel 108. The semicircle ridge 180 is semicircle in shape, is positioned proximate to the exterior container surface 146, and touches the exterior container surface 146 of two of the container walls 122 that are adjacent. The ends of the panel spacing rib are L-shaped. The panel spacing rib 178 is positioned proximate to panel 108 and touches two panels 108 that are adjacent.

Figure 22:
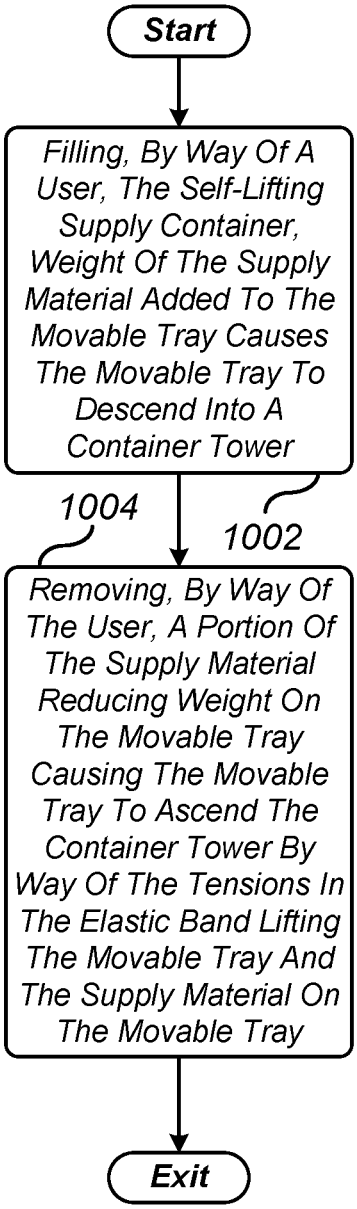
FIG. 22 illustrates one example of a method of using a self-lifting supply container.

Referring to FIG. 22, there is illustrated one example of a method of using a self-lifting supply container 100. The method begins in step 1002 by filling, by way of user 402, the self-lifting supply container 100 with supply material 302.

In operation, the weight of the supply material 302 added to a movable tray 106 causes the movable tray 106 to descend 204 into a container tower 152, tensioning by stretching one or more elastic bands 126.

The self-lifting supply container 100 comprises the movable tray 106, at least one guide 132 that is fastened to each side of the outer perimeter of the movable tray 106. The guide comprises a body portion 174 that is narrow and a head portion 176 that is connected to and wider than the body portion 174.

The self-lifting supply container 100 further comprises more than one container wall 122, each of the container wall 122 has at least one track 182 cut therethrough. Each of the container wall 122 is secured proximate to each other forming the container tower 152. The container tower 152 has a container top 148, a container bottom 150, an interior container region 144, and an exterior container surface 146.

Track 182 is orientated vertically running substantially from the container top 148 to proximate the container bottom 150, the movable tray 106 is sized to fit within the interior container region 144 with the body portion 174 of guide 132 fitting through track 182 and the head portion 176 of guide 132 positioned proximate to the exterior container surface 146 retaining the movable tray 106 within the interior container region 144 and allowing the movable tray 106 to slide up and down track 182 within the interior container region 144. More than one pulley 128 is secured on the exterior container surface 146 of each of the container walls 122 proximate to the container top 148.

The self-lifting supply container further comprises more than one elastic band 126. One end of each of the elastic band 126 is attached 124 to the exterior container surface 146 of the container wall 122 proximate to the container bottom 150, and the other end of the elastic band 126 passes over pulley 128 and is secured to guide 132. The method then moves to step 1004.

In step 1004, by way of user 402, a portion of supply material 302 is removed reducing the weight on the movable tray 106 causing the movable tray 106 to partially ascend 204 the container tower 152 by way of the tension in the elastic bands 126 lifting the movable tray 106 and supply material 302 on the movable tray 106. In this regard, supply material 302 is accessible to user 402 proximate to the container top regardless of the amount of supply material 302 remaining on the movable tray 106 and within interior container region 144 of the self-lifting supply container 100. As such user 402 does not need to reach into the self-lifting supply container when supply material 302 is partially depleted, rather supply material 302 is lifted to the opening surface of the self-lifting supply container. The method is then exited.

The flow diagrams depicted herein are just examples. There may be many variations to these diagrams or the steps (or operations) described therein without departing from the spirit of the invention. For instance, the steps may be performed in a differing order, or steps may be added, deleted, or modified. All of these variations are considered a part of the claimed invention.

While the preferred embodiment of the invention has been described, it will be understood that those skilled in the art, both now and in the future, may make various improvements and enhancements which fall within the scope of the claims which follow. These claims should be construed to maintain the proper protection for the invention first described.

What is claimed is:

1. A self-lifting supply container comprising:

a movable tray;

at least one of a guide is fastened to each side of outer perimeter of the movable tray, the guide comprises a body portion that is narrow and a head portion that is connected to and wider than the body portion;

more than one of a container wall, each of the container wall having at least one of a track cut therethrough, each of the container wall is secured proximate to each other forming a container tower, the container tower having a container top, a container bottom, an interior container region, and an exterior container surface, the track is orientated vertically from the container top to proximate the container bottom, the movable tray is sized to fit within the interior container region with the body portion of the guide fitting through the track and the head portion of the guide positioned proximate to the exterior container surface retaining the movable tray within the interior container region and allowing the movable tray to slide up and down the track within the interior container region;

at least one of a pulley is secured on the exterior container surface of each of the container wall proximate to the container top; and more than one of an elastic band, one end of each of the elastic band is attached to the exterior container surface of the container wall proximate to the container bottom, and other end of the elastic band passes over the pulley and is secured to the guide;

wherein weight of a supply material added to the movable tray causes the movable tray to descend into the container tower, tensioning by stretching the elastic bands and removing portion of the supply material, reducing weight on the movable tray causes the movable tray to partially ascend the container tower, by way of tension in the elastic band, lifting the movable tray and the supply material on the movable tray;

wherein the supply material is accessible to a user proximate to the container top regardless of the amount of the supply material remaining on the movable tray within the self-lifting supply container.

2. The self-lifting supply container in accordance with claim 1, there are two of the track, two of the pulley, and two of the elastic band one each of four of the container wall.

3. The self-lifting supply container in accordance with claim 1, further comprising:

at least one of a track spanning guide stop is fastened across the track proximate to the container top, the track spanning guide secures edges of the track from motion and blocks the guide from being removable from the track.

4. The self-lifting supply container in accordance with claim 1, further comprising:

more than one of a panel, the panel comprises a top panel edge, a bottom panel edge, a left panel edge, a right panel edge, an exterior panel surface, and an interior panel surface, at least one of the panel is attached to the exterior container surface of each of the container wall.

5. The self-lifting supply container in accordance with claim 4, further comprising:

a strengthening weave is integrally formed on the interior panel surface to increase the rigidity and structural strength of the panel.

6. The self-lifting supply container in accordance with claim 4, each of the left panel edge and the right panel edge have more than one of a mounting hole therethrough such that the panel is fastened to the container wall, and the left panel edge and the right panel edge are contoured at a 45-degree angle with respect to the container wall.

7. The self-lifting supply container in accordance with claim 4, further comprising:

a collar is sized to fit perimeter of the container tower and fastens to the container top, the collar having a top collar surface and a bottom collar surface;

more than one of a panel alignment mount, at least one of the panel alignment mount is integrally formed on the bottom collar surface at each corner of the collar, the collar is fitted on the container top with the panel alignment mount positioned between the exterior container surface and the interior panel surface, the collar extends around and secures the container top of the container wall and the top panel edge of the panel.

8. The self-lifting supply container in accordance with claim 7, the panel alignment mount comprises a semicircle ridge and a panel spacing rib each of which is integrally formed on the bottom collar surface, the semicircle ridge and the panel spacing rib are separated by a gap, the gap is sized in width to allow the pulley, the elastic band, and the guide to operate unencumbered between the container wall and the panel, the semicircle ridge is semicircle in shape, is positioned proximate to the exterior container surface, and touches the exterior container surface of two of the container wall that are adjacent, ends of the panel spacing rib are L-shaped, the panel spacing rib is positioned proximate to the panel, and touches two of the panel that are adjacent.

9. The self-lifting supply container in accordance with claim 7, further comprising:

a lid is sized to cover the collar, the lid comprises a first interlocking row of ridges integrally formed along one perimeter edge, the collar comprises a second interlocking row of ridges integrally formed along one perimeter edge, the first interlocking row of ridges and the second interlocking row of ridges movably interconnected such that the lid can be opened by the user to access the supply material within the container interior region, and closed to cover the supply material within the container interior region.

10. The self-lifting supply container in accordance with claim 4, further comprising:

a panel contoured lip formed on the bottom panel edge on at least two of the panel that are opposed; and a bottom plate comprises a contoured lip on at least two opposing perimeter edges, the contoured lip engages top surface of the panel contoured lip securing the bottom plate proximate to bottom of the container tower, the bottom plate covers the container bottom.

11. The self-lifting supply container in accordance with claim 10, further comprising:

more than one of a strengthening rib is integrally formed in a row along union between the interior panel surface and the panel contoured lip.

12. The self-lifting supply container in accordance with claim 4, further comprising:

more than one of a footer formed into a U-shape, the U-shape creates a panel gap, the footer having a footer mounting hole therethrough, adjacent left panel edge and the right panel edge overlap and slide into the panel gap and a footer fastener passes through the footer mounting hole securing the footer to the panel.

13. A method is using a self-lifting supply container, the method comprising the steps of:

filling, by way of a user, the self-lifting supply container with a supply material, weight of the supply material added to a movable tray causes the movable tray to descend into a container tower, tensioning by stretching one or more of an elastic band, the self-lifting supply container comprises the movable tray, at least one of a guide is fastened to each side of outer perimeter of the movable tray, the guide comprises a body portion that is narrow and a head portion that is connected to and wider than the body portion, more than one of a container wall, each of the container wall having at least one of a track cut therethrough, each of the container wall is secured proximate to each other forming the container tower, the container tower having a container top, a container bottom, an interior container region, and an exterior container surface, the track is orientated vertically from the container top to proximate the container bottom, the movable tray is sized to fit within the interior container region with the body portion of the guide fitting through the track and the head portion of the guide positioned proximate to the exterior container surface retaining the movable tray within the interior container region and allowing the movable tray to slide up and down the track within the interior container region, at least one of a pulley is secured on the exterior container surface of each of the container wall proximate to the container top, and more than one of the elastic band, one end of each of the elastic band is attached to the exterior container surface of the container wall proximate to the container bottom, and other end of the elastic band passes over the pulley and is secured to the guide; and removing, by way of the user, portion of the supply material, reducing weight on the movable tray causing the movable tray to partially ascend the container tower by way of tension in the elastic band lifting the movable tray and the supply material on the movable tray, wherein the supply material is accessible to the user proximate to the container top regardless of the amount of the supply material remaining on the movable tray within the self-lifting supply container.

14. A self-lifting supply container comprising:

a movable tray;

at least one of a guide is fastened to each side of outer perimeter of the movable tray, the guide comprises a body portion that is narrow and a head portion that is connected to and wider than the body portion;

more than one of a container wall, each of the container wall having at least one of a track cut therethrough, each of the container wall is secured proximate to each other forming a container tower, the container tower having a container top, a container bottom, an interior container region, and an exterior container surface, the track is orientated vertically from the container top to proximate the container bottom, the movable tray is sized to fit within the interior container region with the body portion of the guide fitting through the track and the head portion of the guide positioned proximate to the exterior container surface retaining the movable tray within the interior container region and allowing the movable tray to slide up and down the track within the interior container region;

at least one of a pulley is secured on the exterior container surface of each of the container wall proximate to the container top;

more than one of an elastic band, one end of each of the elastic band is attached to the exterior container surface of the container wall proximate to the container bottom, and other end of the elastic band passes over the pulley and is secured to the guide;

a lid, the lid comprises a first interlocking row of ridges integrally formed along one perimeter edge;

a collar is sized to fit perimeter of the container tower and fastens to the container top, the collar having a top collar surface and a bottom collar surface, the lid is sized to cover the collar, the collar comprises a second interlocking row of ridges integrally formed along one perimeter edge, the first interlocking row of ridges and the second interlocking row of ridges movably interconnected such that the lid can be opened by a user to access a supply material within the container interior region, and closed to cover the supply material within the container interior region;

more than one of a panel, the panel comprises a top panel edge, a bottom panel edge, a left panel edge, a right panel edge, an exterior panel surface, and an interior panel surface, at least one of the panel is attached to the exterior container surface of each of the container wall;

a panel contoured lip formed on the bottom panel edge on at least two of the panel that are opposed;

a bottom plate comprises a contoured lip on at least two opposing perimeter edges, the contoured lip engages top surface of the panel contoured lip securing the bottom plate proximate to bottom of the container tower, the bottom plate covers the container bottom; and more than one of a footer formed into a U-shape, the U-shape creates a panel gap, the footer having a footer mounting hole therethrough, adjacent left panel edge and the right panel edge overlap and slide into the panel gap and a footer fastener passes through the footer mounting hole securing the footer to the panel;

wherein weight of the supply material added to the movable tray causes the movable tray to descend into the container tower, tensioning by stretching the elastic bands and removing portion of the supply material, reducing weight on the movable tray causes the movable tray to partially ascend the container tower, by way of tension in the elastic band, lifting the movable tray and the supply material on the movable tray;

wherein the supply material is accessible to the user proximate to the container top regardless of the amount of the supply material remaining on the movable tray within the self-lifting supply container.

15. The self-lifting supply container in accordance with claim 14, further comprising:

at least one of a track spanning guide stop is fastened across the track proximate to the container top, the track spanning guide secures edges of the track from motion and blocks the guide from being removable from the track.

16. The self-lifting supply container in accordance with claim 14, further comprising:

a strengthening weave is integrally formed on the interior panel surface to increase the rigidity and structural strength of the panel.

17. The self-lifting supply container in accordance with claim 14, further comprising:

more than one of a panel alignment mount, at least one of the panel alignment mount is integrally formed on the bottom collar surface at each corner of the collar, the collar is fitted on the container top with the panel alignment mount positioned between the exterior container surface and the interior panel surface, the collar extends around and secures the container top of the container wall and the top panel edge of the panel.

18. The self-lifting supply container in accordance with claim 17, the panel alignment mount comprises a semicircle ridge and a panel spacing rib each of which is integrally formed on the bottom collar surface, the semicircle ridge and the panel spacing rib are separated by a gap, the gap is sized in width to allow the pulley, the elastic band, and the guide to operate unencumbered between the container wall and the panel, the semicircle ridge is semicircle in shape, is positioned proximate to the exterior container surface, and touches the exterior container surface of two of the container wall that are adjacent, ends of the panel spacing rib are L-shaped, the panel spacing rib is positioned proximate to the panel, and touches two of the panel that are adjacent.

19. The self-lifting supply container in accordance with claim 14, each of the left panel edge and the right panel edge have more than one of a mounting hole therethrough such that the panel is fastened to the container wall, and the left panel edge and the right panel edge are contoured at a 45-degree angle with respect to the container wall.

20. The self-lifting supply container in accordance with claim 14, further comprising:

more than one of a strengthening rib is integrally formed in a row along union between the interior panel surface and the panel contoured lip.

* * * * *